US009897032B2

(12) United States Patent
Sugimoto et al.

(10) Patent No.: US 9,897,032 B2
(45) Date of Patent: Feb. 20, 2018

(54) FUEL INJECTION DEVICE

(71) Applicant: SUZUKI MOTOR CORPORATION, Hamamatsu-shi, Shizuoka (JP)

(72) Inventors: Kenta Sugimoto, Hamamatsu (JP); Kazuyoshi Shimatani, Hamamatsu (JP)

(73) Assignee: SUZUKI MOTOR CORPORATION, Hamamatsu-Shi (JP)

( * ) Notice: Subject to any disclaimer, the term of this patent is extended or adjusted under 35 U.S.C. 154(b) by 228 days.

(21) Appl. No.: 14/933,588

(22) Filed: Nov. 5, 2015

(65) Prior Publication Data

US 2016/0131071 A1 May 12, 2016

(30) Foreign Application Priority Data

Nov. 6, 2014 (JP) ..... 2014-225943

(51) Int. Cl.
*F02D 41/00* (2006.01)
*F02D 41/30* (2006.01)
(Continued)

(52) U.S. Cl.
CPC ..... *F02D 41/3005* (2013.01); *F02D 41/009* (2013.01); *F02D 41/0097* (2013.01);
(Continued)

(58) Field of Classification Search
CPC .... F02D 41/3005; F02D 41/10; F02D 41/009; F02D 41/0097; F02D 41/1498; F02D 2200/0406
See application file for complete search history.

(56) References Cited

U.S. PATENT DOCUMENTS 6,983,738 B2 1/2006 Nakamura ..... 123/492
7,669,578 B2 3/2010 Yamashita et al. ..... 123/295
(Continued)

FOREIGN PATENT DOCUMENTS

JP H 11-247681 A 9/1999
JP 2002-147269 A 5/2002
(Continued)

OTHER PUBLICATIONS

Notification of Reasons for Refusal dated Dec. 5, 2017, issued to Japanese Application No. 2014-225943.

*Primary Examiner* — Hieu T Vo
*Assistant Examiner* — Sherman Manley
(74) *Attorney, Agent, or Firm* — Stein IP, LLC

(57) ABSTRACT

There is provided a fuel injection device. Based on a current intake air pressure and a previous intake air pressure of an engine at the predetermined crank position, an intake air pressure variation of the engine at the predetermined crank position is calculated as a measured intake air pressure variation. Based on the current rotational speed and the previous rotational speed of the engine at the predetermined crank position, and a fully-closed-state intake air pressure conversion data item, the fully-closed-state intake air pressure variation of the engine at the predetermined crank position is calculated. The measured intake air pressure variation is corrected based on the fully-closed-state intake air pressure variation. Based on the corrected measured intake air pressure variation, the current rotational speed at the predetermined crank position, and the transient fuel injection quantity conversion data item, the transient fuel injection quantity at the predetermined crank position is determined.

10 Claims, 10 Drawing Sheets

(51) Int. Cl.
*F02D 41/14* (2006.01)
*F02D 41/10* (2006.01)

(52) U.S. Cl.
CPC ..... *F02D 41/10* (2013.01); *F02D 41/1498* (2013.01); *F02D 2200/0406* (2013.01)

(56) References Cited

U.S. PATENT DOCUMENTS

| | | | | |
|---|---|---|---|---|
| 2002/0104512 | A1* | 8/2002 | Iwasaki | F01L 1/34 123/478 |
| 2004/0244773 | A1 | 12/2004 | Nakamura | 123/403 |
| 2008/0178836 | A1 | 7/2008 | Yamashita et al. | 123/295 |
| 2016/0363086 | A1* | 12/2016 | Otani | F02D 41/3011 |
| 2017/0138282 | A1* | 5/2017 | Wooldridge | F02D 41/0077 |
| 2017/0241355 | A1* | 8/2017 | Wooldridge | F02D 41/0072 |

FOREIGN PATENT DOCUMENTS

| | | | |
|---|---|---|---|
| JP | 2007-224810 | A | 9/2007 |
| JP | 2007-332944 | A | 12/2007 |
| JP | 2008-184968 | A | 8/2008 |
| JP | 2012-047145 | A | 3/2012 |
| JP | 2012-246784 | A | 12/2012 |
| JP | 2013-194532 | A | 9/2013 |
| WO | WO 03/038261 | A1 | 5/2003 |

* cited by examiner

FUEL INJECTION DEVICE

CROSS-REFERENCE TO RELATED APPLICATIONS

The disclosure of Japanese Patent Application No. 2014-225943 filed on Nov. 6, 2014, including specification, drawings and claims is incorporated herein by reference in its entirety.

TECHNICAL FIELD

The present invention relates to a fuel injection device for performing fuel injection in the intake passage of an engine (an internal-combustion engine) so as to operate the engine.

BACKGROUND

A fuel injection device which is usable in an engine to be mounted on a saddle ridden type vehicle such as a motorcycle has an injector provided in the vicinity of an intake port in the intake passage of the engine, a sensor for detecting the position of a crank and the rotational speed of the engine, a sensor for detecting intake air pressure, a sensor for detecting the opening degree of a throttle, and a control unit for controlling the operation of the injector on the basis of outputs of those sensors. In this fuel injection device, the control unit performs a fuel injection process of calculating a fuel injection quantity on the basis of outputs of the sensors and controlling the injector such that the injector injects fuel of the calculated fuel injection quantity.

As fuel injection processes, there are a basic fuel injection process for normal driving and a transient fuel injection process for transient driving such as the time of accelerating. In the basic fuel injection process, in order to calculate a basic fuel injection quantity, a calculation system using intake air pressure and engine rotational speed (a speed density system) or a calculation system using the opening degree of a throttle and engine rotational speed (a throttle speed system) may be used. In a case where the resolution of intake air pressure is higher than the resolution of the opening degree of a throttle, the speed density system is often used to calculate a basic fuel injection quantity. In contrast, in a case where the resolution of throttle the opening degree of a throttle is higher than the resolution of intake air pressure, the throttle speed system is often used to calculate a basic fuel injection quantity. Meanwhile, in the transient fuel injection process, since the opening degree of a throttle is good in responsivity, in order to calculate a transient fuel injection quantity, a system using the opening degree of a throttle and engine rotational speed is often used.

Meanwhile, in Patent Document 1, there is disclosed an engine control device which sets a fuel injection quantity for acceleration on the basis of engine rotational speed and an intake air pressure difference.

Patent Document 1: WO 2003/038261

By the way, if a calculation system using intake air pressure and engine rotational speed is used with respect not only to basic fuel injection quantities but also to transient fuel injection quantities, it becomes unnecessary to acquire the opening degree of a throttle. Therefore, it is possible to remove a throttle sensor from an engine, and it is possible to reduce the size and manufacturing cost of the engine. For this reason, in a transient fuel injection process, it is required to calculate a transient fuel injection quantity on the basis of intake air pressure and engine rotational speed.

In the transient fuel injection process, it is required to implement high responsivity of an engine, for example, by immediately performing transient fuel injection in response to a driver's driving operation on a motorcycle. However, in the transient fuel injection process, in a case of calculating a transient fuel injection quantity on the basis of intake air pressure and engine rotational speed, it is not easy to implement high responsivity of the engine.

That is, in general, in a basic fuel injection process of calculating a basic fuel injection quantity on the basis of intake air pressure and engine rotational speed, detection of intake air pressure is performed in an intake stroke or in a compression stroke, and basic fuel injection of the basic fuel injection quantity calculated on the basis of the result of the intake air pressure detection is performed in an exhaust stroke or in the intake stroke of the next cycle. Therefore, between a driver's driving operation and performance of basic fuel injection based on a basic fuel injection quantity changed in response to the corresponding driving operation, a time lag occurs. As a result, in the basic fuel injection process of calculating a basic fuel injection quantity on the basis of intake air pressure and engine rotational speed, the responsivity of the engine to a driving operation is low. Therefore, in a case of using the basic fuel injection quantity calculation method of the basic fuel injection process to calculate a transient fuel injection quantity in a transient fuel injection process, it is difficult to implement high responsivity of the engine. For this reason, as a method of calculating transient fuel injection quantity on the basis of intake air pressure and engine rotational speed, a new method different from the basic fuel injection quantity calculation method of the basic fuel injection process as described above needs to be devised. However, this is not easy.

In Patent Document 1, an acceleration state is detected on the basis of an intake air pressure difference. In a case where an acceleration state is detected, a fuel injection quantity for acceleration is determined on the basis of engine rotational speed and the intake air pressure difference, and fuel injection of the fuel injection quantity for acceleration is immediately performed such that an acceleration feeling intended by the driver can be obtained.

However, in Patent Document 1, with respect to calculation of a fuel injection quantity for acceleration according to engine rotational speed and an intake air pressure difference, it is just disclosed that a fuel injection quantity for acceleration is calculated from a three-dimensional map, and the content of the three-dimensional map is not disclosed. For this reason, from the disclosure of Patent Document 1, whether it is possible to calculate an accurate transient fuel injection quantity according to a driving operation is not apparent, and it is not easy to generate a three-dimensional map for implementing calculation of an accurate transient fuel injection quantity.

SUMMARY

It is an object of the present invention to provide a fuel injection device capable of implementing determination of an accurate transient fuel injection quantity and quick performance of transient fuel injection according to a driving operation during transient driving, on the basis of intake air pressure and engine rotational speed.

According to an aspect of the embodiments of the present invention, there is provided a fuel injection device for performing fuel injection in an engine, comprising: a crank position detecting unit configured to detect a position of a crank of the engine; a speed measuring unit configured to measure a rotational speed of the engine; an intake air pressure measuring unit configured to measure an intake air pressure of the engine; a fuel injecting unit configured to inject fuel in the engine; a storage unit; and a control unit configured to determine a transient fuel injection quantity which is a quantity of transient fuel injection which is fuel injection during transient driving, and to control the transient fuel injection of the fuel injecting unit, wherein if a variation in the intake air pressure for one cycle of the engine is referred to as an intake air pressure variation, and the intake air pressure of the engine when a throttle valve for opening and closing an intake passage of the engine is in a fully closed state is referred to as fully-closed-state intake air pressure, and a variation in the fully-closed-state intake air pressure for one cycle of the engine is referred to as a fully-closed-state intake air pressure variation, in the storage unit, a transient fuel injection quantity conversion data item defining a relation of the intake air pressure variation of the engine, the rotational speed of the engine, and the transient fuel injection quantity of the engine at a predetermined crank position in advance, and a fully-closed-state intake air pressure conversion data item defining a relation between the rotational speed of the engine and the fully-closed-state intake air pressure of the engine in the predetermined crank position in advance are stored, wherein the control unit recognizes the predetermined crank position on the basis of detection of the crank position detecting unit, wherein the control unit recognizes a current rotational speed of the engine measured at the predetermined crank position by the speed measuring unit, and a previous rotational speed of the engine measured one cycle before by the speed measuring unit, wherein the control unit recognizes a current intake air pressure of the engine measured at the predetermined crank position by the intake air pressure measuring unit, and a previous intake air pressure of the engine measured one cycle before by the intake air pressure measuring unit, wherein on the basis of the current intake air pressure and the previous intake air pressure of the engine at the predetermined crank position, the control unit calculates the intake air pressure variation of the engine at the predetermined crank position, as a measured intake air pressure variation, wherein on the basis of the current rotational speed and the previous rotational speed of the engine at the predetermined crank position, and the fully-closed-state intake air pressure conversion data item, the control unit calculates the fully-closed-state intake air pressure variation of the engine at the predetermined crank position, wherein the control unit corrects the measured intake air pressure variation on the basis of the fully-closed-state intake air pressure variation, and wherein on the basis of the corrected measured intake air pressure variation, the current rotational speed of the engine at the predetermined crank position, and the transient fuel injection quantity conversion data item, the control unit determines the transient fuel injection quantity of the engine at the predetermined crank position.

According to the fuel injection device of the present invention described above, since the measured intake air pressure variation is corrected on the basis of the fully-closed-state intake air pressure variation, it is possible to determine an accurate transient fuel injection quantity according to a driving operation. That is, the measured intake air pressure variation includes an intake air pressure variation corresponding to, for example, a driving operation (an accelerator operation) of a driver for accelerating a motorcycle. This is an intake air pressure variation which is caused by a variation in the opening degree of the throttle valve. In addition to this, the measured intake air pressure variation includes an intake air pressure variation which is caused by a variation in the engine rotational speed. By the way, the fully-closed-state intake air pressure variation is an intake air pressure variation in a case where the throttle valve is in a fully closed state, that is, an intake air pressure variation in a state where the opening degree of the throttle valve does not vary, and intake air rarely flows. For this reason, the fully-closed-state intake air pressure variation substantially corresponds to the variation in the engine rotational speed. Therefore, by correcting the measured intake air pressure variation on the basis of the fully-closed-state intake air pressure variation, it is possible to remove the intake air pressure variation which is caused by the variation in the engine rotational speed, from the measured intake air pressure variation. As a result, the corrected measured intake air pressure variation substantially corresponds to an intake air pressure variation which is caused by the variation in the opening degree of the throttle valve. For this reason, the transient fuel injection quantity is determined on the basis of the corrected measured intake air pressure variation. Therefore, it is possible to accurately obtain a transient fuel injection quantity corresponding to a variation in the opening degree of the throttle valve, that is, a transient fuel injection quantity according to a driving operation.

In the fuel injection device, the predetermined crank position may be set as a plurality of predetermined crank positions in the one cycle, and in the storage unit, a plurality of different transient fuel injection quantity conversion data items determined for the plurality of predetermined crank positions, and a plurality of different fully-closed-state intake air pressure conversion data items determined for the plurality of predetermined crank positions may be stored.

Therefore, it is possible to perform transient fuel injection quantity determination and transient fuel injection at a plurality of crank positions in one cycle of the engine, and it is possible to quickly transient fuel injection according to a driving operation. Also, the relation of the intake air pressure variation, the engine rotational speed, and the transient fuel injection quantity varies depending on the position of the crank. Therefore, the transient fuel injection quantity conversion data items are prepared for a plurality of predetermined crank positions, and the fully-closed-state intake air pressure conversion data items are prepared for the predetermined crank positions. Then, at each crank position a transient fuel injection quantity is determined on the basis of a transient fuel injection quantity conversion data item and a fully-closed-state intake air pressure conversion data item corresponding to the corresponding crank position, at each crank position. Therefore, it is possible to accurately determine a transient fuel injection quantity according to a driving operation.

In the fuel injection device, one of the plurality of predetermined crank positions may be set in an intake stroke of the engine, and another one may be set in an expansion stroke or exhaust stroke of the engine.

In the intake stroke of the engine, the intake air pressure significantly varies depending on the opening degree of the throttle valve, as compared to the other strokes. Therefore, one predetermined crank position for determining a transient fuel injection quantity is set in the intake stroke of the engine. As a result, it is possible to minutely perform determination of a transient fuel injection quantity according to the opening degree of the throttle valve, and it is possible to accurately obtain an exact transient fuel injection quantity corresponding to a fine driving operation.

Also, another crank position for determining a transient fuel injection quantity is set in the expansion stroke or exhaust stroke of the engine, and not only in the intake stroke but also the expansion stroke or the exhaust stroke, transient fuel injection is performed. Therefore, even in a case where a required transient fuel injection quantity is large, it is possible to surely and quickly perform injection of the whole quantity, and it is possible to improve the accuracy and rapidity of transient fuel injection. That is, for example, at the time of operating the engine in a case where the engine is cold, at the time of driving in a low-temperature environment, or when the opening degree of the throttle valve has suddenly and significantly increased due to a sudden and significant accelerator operation, a required transient fuel injection quantity may suddenly increase so as to exceed a fuel injection quantity injectable by transient fuel injection which is performed in the intake stroke. Even in this case, according to the present invention, since transient fuel injection is distributively performed in the intake stroke and any one of the expansion stroke and the exhaust stroke, it is possible to surely and early perform injection of the whole of the transient fuel injection quantity.

In the fuel injection device, two of the plurality of predetermined crank positions may be set at different positions in an intake stroke of the engine, respectively.

As described above, two crank positions for determining a transient fuel injection quantity are set in the intake stroke of the engine, and transient fuel injection is performed twice in the intake stroke. Therefore, it is possible to improve the accuracy of transient fuel injection according to a driving operation. Especially, it is possible to implement accurate transient fuel injection according to a quick accelerator operation for a short time like a snap operation.

In the fuel injection device, the control unit may control the fuel injecting unit to perform the transient fuel injection at each of the plurality of predetermined crank positions.

As a result, on the basis of the intake air pressure and the engine rotational speed, it is possible to implement quick performance of transient fuel injection according to a driving operation during transient driving.

In the fuel injection device, if a certain crank position in the one cycle of the engine is referred to as a reference crank position, and a range corresponding to one cycle from the reference crank position is referred to as a reference cycle, and a crank position at which the transient fuel injection is performed in the reference cycle is referred to as a performance crank position, and crank positions at which the transient fuel injection has been already performed in the reference cycle are referred to as performance completion crank positions, the control unit may subtract a sum of transient fuel injection quantities of the transient fuel injection performed at the performance completion crank positions from the transient fuel injection quantity determined on the basis of the corrected measured intake air pressure variation, the rotational speed of the engine, and the transient fuel injection quantity conversion data items at the performance crank position, thereby obtaining a transient fuel injection quantity, and sets the obtained transient fuel injection quantity as the transient fuel injection quantity for transient fuel injection to be performed at the performance crank position.

As described above, a plurality of processes for determining transient fuel injection quantities in one cycle is associated with each other, whereby second and subsequent transient fuel injection quantities in one cycle are adjusted. Therefore, it is possible to remove a common quantity to the plurality of transient fuel injection quantities determined in one cycle, and it is possible to prevent each transient fuel injection quantity from excessively increasing.

According to another aspect of the embodiments of the present invention, there is provided a fuel injection device for performing fuel injection in an engine, comprising: a crank position detecting unit configured to perform a position of a crank of the engine; a speed measuring unit configured to measure a rotational speed of the engine; an intake air pressure measuring unit configured to measure an intake air pressure of the engine; a fuel injecting unit configured to inject fuel in the engine; a storage unit; and a control unit configured to determine a transient fuel injection quantity which is a quantity of transient fuel injection which is fuel injection during transient driving, and to control the transient fuel injection of the fuel injecting unit, wherein if a variation in the intake air pressure for one cycle of the engine is referred to as an intake air pressure variation, in the storage unit, a transient fuel injection quantity conversion data item defining a relation of the intake air pressure variation of the engine, the rotational speed of the engine, and the transient fuel injection quantity of the engine at a predetermined crank position in advance is stored, wherein the control unit recognizes the predetermined crank position on the basis of detection of the crank position detecting unit, wherein the control unit recognizes a current rotational speed of the engine measured at the predetermined crank position by the speed measuring unit, wherein the control unit recognizes a current intake air pressure of the engine measured at the predetermined crank position by the intake air pressure measuring unit, and a previous intake air pressure of the engine measured one cycle before by the intake air pressure measuring unit, wherein on the basis of the current intake air pressure and the previous intake air pressure of the engine at the predetermined crank position, the control unit calculates the intake air pressure variation of the engine at the predetermined crank position, as a measured intake air pressure variation, wherein on the basis of the measured intake air pressure variation, the current rotational speed of the engine at the predetermined crank position, and the transient fuel injection quantity conversion data item, the control unit determines the transient fuel injection quantity of the engine at the predetermined crank position, wherein the control unit controls the fuel injecting unit to perform the transient fuel injection of the determined transient fuel injection quantity at the predetermined crank position, and wherein the predetermined crank position is set as a plurality of predetermined crank positions in the one cycle, and at each of the plurality of crank positions, the control unit performs determination of the transient fuel injection quantity and the transient fuel injection of the determined transient fuel injection quantity.

As described above, in one cycle, determination of a transient fuel injection quantity based on the variation between the current intake air pressure and previous intake air pressure and the engine rotational speed, and transient fuel injection of the corresponding transient fuel injection quantity are performed a plurality of times. Therefore, it is possible to implement determination of an accurate transient fuel injection quantity and quick performance of transient fuel injection according to a driving operation during transient driving.

In the fuel injection device, one of the plurality of predetermined crank positions may be set in an intake stroke of the engine, and another one may be set in an expansion stroke or exhaust stroke of the engine.

As described above, one predetermined crank position for performing determination of a transient fuel injection quantity and transient fuel injection is set in the intake stroke of the engine. Therefore, it is possible to minutely perform determination of a transient fuel injection quantity according to the opening degree of the throttle valve, and it is possible to accurately obtain an exact transient fuel injection quantity corresponding to a fine driving operation.

Also, another crank position for performing determination of a transient fuel injection quantity and transient fuel injection is set in the expansion stroke or exhaust stroke of the engine. Therefore, for example, at the time of operating the engine in a case where the engine is cold, at the time of driving in a low-temperature environment, or at the time of a sudden and significant accelerator operation, even if a transient fuel injection quantity suddenly increases so as to exceed a fuel injection quantity injectable by transient fuel injection which is performed in the intake stroke, it is possible to surely and quickly perform injection of the whole of the transient fuel injection quantity, and it is possible to improve the accuracy and rapidity of transient fuel injection.

In the fuel injection device, two of the plurality of predetermined crank positions may be set at different positions in an intake stroke of the engine, respectively.

As a result, it is possible to improve the accuracy of transient fuel injection according to a driving operation. Especially, it is possible to implement accurate transient fuel injection according to a quick accelerator operation for a short time like a snap operation.

In the fuel injection device, if a certain crank position in the one cycle of the engine is referred to as a reference crank position, and a range corresponding to one cycle from the reference crank position is referred to as a reference cycle, and a crank position at which the transient fuel injection is performed in the reference cycle is referred to as a performance crank position, and crank positions at which the transient fuel injection has been already performed in the reference cycle is referred to as performance completion crank positions, the control unit may subtract a sum of transient fuel injection quantities of the transient fuel injection performed at the performance completion crank positions from the transient fuel injection quantity determined on the basis of the measured intake air pressure variation, the rotational speed of the engine, and the transient fuel injection quantity conversion data items at the performance crank position, thereby obtaining a transient fuel injection quantity, and sets the obtained transient fuel injection quantity as the transient fuel injection quantity for transient fuel injection to be performed at the performance crank position.

As a result, it is possible to remove a common quantity to the plurality of transient fuel injection quantities determined in one cycle, and it is possible to prevent each transient fuel injection quantity from excessively increasing.

According to the present invention, it is possible to implement determination of an accurate transient fuel injection quantity and quick performance of transient fuel injection according to a driving operation during transient driving, on the basis of intake air pressure and engine rotational speed.

DETAILED DESCRIPTION OF THE EMBODIMENTS

Hereinafter, an embodiment of the present invention will be described with reference to the accompanying drawings.

(Configuration of Fuel Injection Device)

Figure 1:
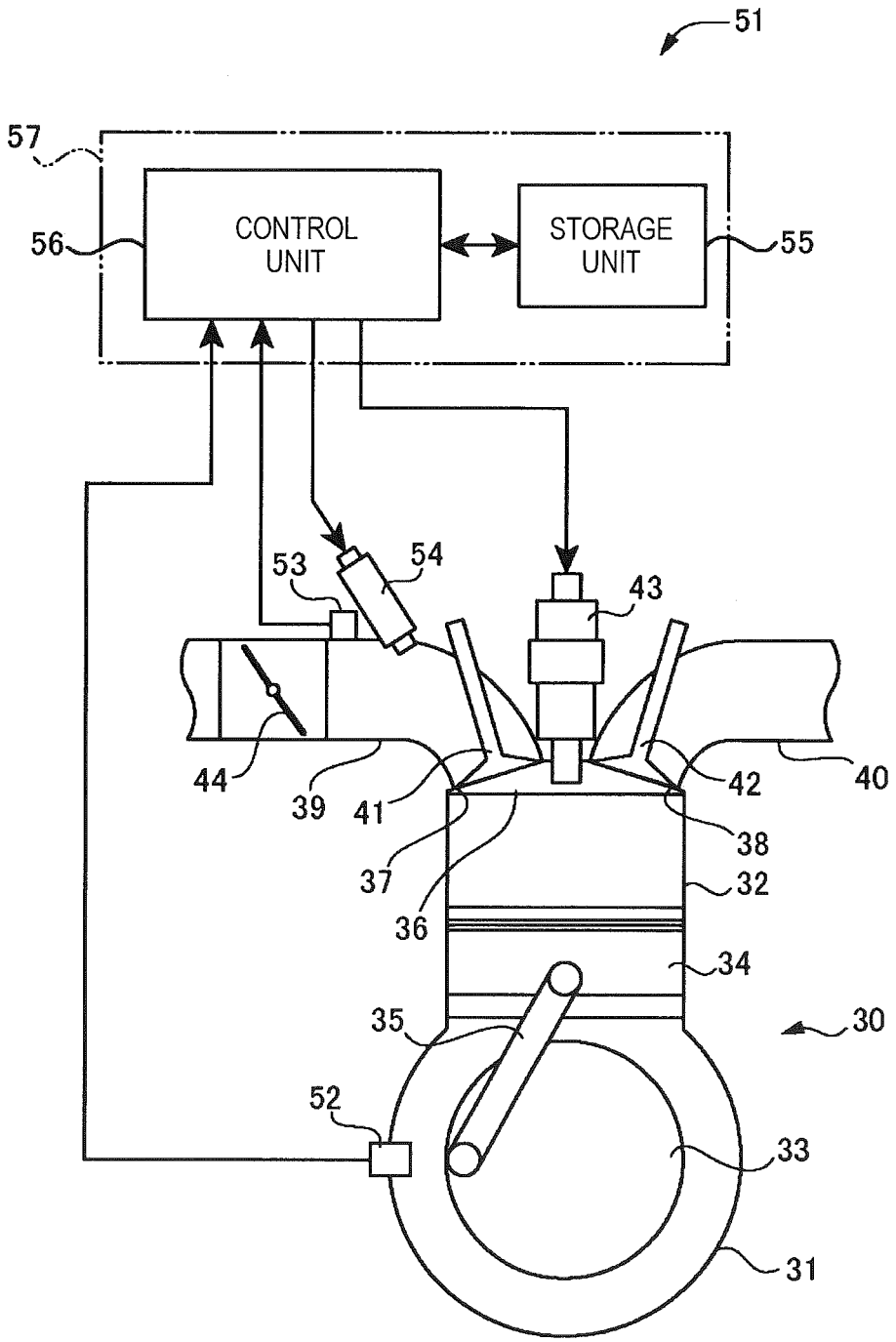
FIG. 1 is an explanatory view illustrating an engine equipped with a fuel injection device according to an embodiment of the present invention.

FIG. 1 shows an engine equipped with a fuel injection device according to the embodiment of the present invention. In FIG. 1, an engine 30 is a single-cylinder four-cycle engine which can be used in a saddle ridden type vehicle such as a motorcycle. The engine 30 includes a crank case 31 which holds a crankshaft 33 therein. On the crank case 31, a cylinder body 32 is attached. Inside the cylinder body 32, some components such as a piston 34 and a connecting rode 35 for connecting the crankshaft 33 and the piston 34 are provided. Also, on the head part of the cylinder body 32, a cylinder head 36 is attached, and an intake port 37 and an exhaust port 38 formed at the cylinder head 36 are connected to an intake pipe 39 and an exhaust pipe 40, respectively. Further, at the cylinder head 36, an intake valve 41 for opening and closing the intake port 37, an exhaust valve 42 for opening and closing the exhaust port 38, and a spark plug 43 are provided. Furthermore, in a portion of the intake pipe 39, a throttle valve 44 is provided to be opened and closed in tandem with an operation on accelerator so as to change the section area of the passage of the intake pipe 39 (the intake passage), thereby adjusting the amount of air flowing in the intake pipe 39.

Also, in the engine 30, a fuel injection device 51 according to the embodiment of the present invention is provided.

The fuel injection device 51 is a device for performing fuel injection in the engine 30. The fuel injection device 51 includes a crank sensor 52 which acts as a crank position detecting unit and a speed measuring unit, an intake air pressure sensor 53 which acts as an intake air pressure measuring unit, an injector 54 which acts as a fuel injecting unit, a storage unit 55, and a control unit 56.

The crank sensor 52 is provided on the crank case 31, and detects the position of the crank in the engine 30, and measures the rotational speed of the engine 30. The intake air pressure sensor 53 is provided in a portion of the intake pipe 39 so as to be close to the intake port 37, and measures intake air pressure which is the pressure of the inside of the intake pipe 39. The injector 54 is provided on a portion of the intake pipe 39, and injects fuel into the intake air pressure sensor 53. The storage unit 55 and the control unit 56 are provided at the saddle ridden type vehicle, and are, for example, parts of an engine control unit 57 for generally performing a variety of control on the engine 30. The control unit 56 is an arithmetic processing unit, and the storage unit 55 is, for example, a memory having semiconductor memory elements. The input terminal of the control unit 56 is connected to some components such as the intake air pressure sensor 53 and the crank sensor 52 through electric cables. Also, the output terminal of the control unit 56 is connected to some components such as the injector 54 and the spark plug 43 through electric cables. Further, the control unit 56 and the storage unit 55 are connected to each other through a bus. A transient fuel injection process (to be described below) is performed under control of the control unit 56, and values and data which are used in the transient fuel injection process are stored in the storage unit 55.

Figure 2:
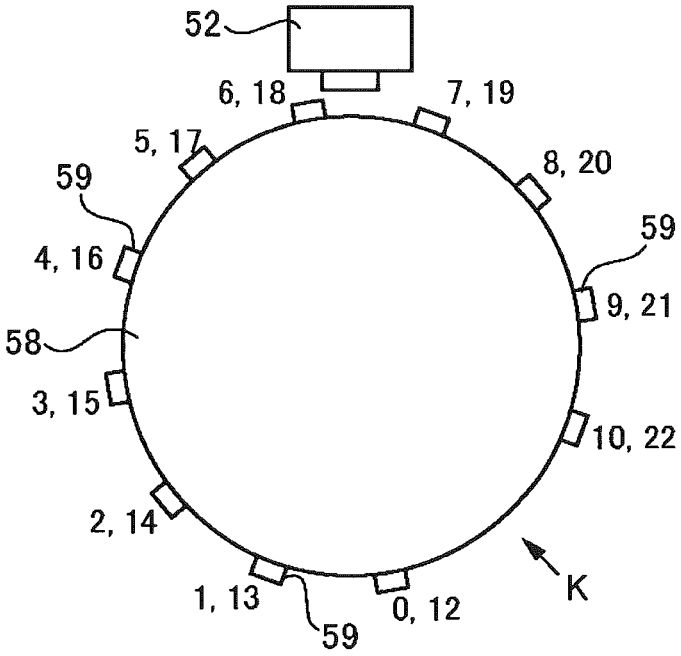
FIG. 2 is an explanatory view illustrating a mechanism for performing crank position detection and engine rotational speed measurement in the fuel injection device according to the embodiment of the present invention.

FIG. 2 shows a mechanism for performing crank position detection and engine rotational speed measurement by the crank sensor 52. As shown in FIG. 2, inside the crank case 31, a disk 58 for detecting the position of the crank is provided. The disk 58 rotates in sync with the crankshaft 33, and has a plurality of protruding teeth 59 on the periphery. For example, on the periphery of the disk 58 excepting for a portion indicated by an arrow "K", eleven teeth 59 are arranged at intervals of 30 degrees with the center of the disk 58 as a reference.

Meanwhile, the crank sensor 52 has a magnetic sensor, and is disposed in the vicinity of the periphery of the disk 58. The crank sensor 52 outputs, to the control unit 56, crank pulses which are, for example, a pulse signal which rises if each tooth 59 approaches the crank sensor 52. The disk 58 revolves two times in one cycle of the engine 30 which is composed of an intake stroke, a compression stroke, an expansion stroke, and an exhaust stroke. Therefore, in a case where the rotational speed of the engine 30 is constant, crank pulses are output at intervals of a twenty-fourth of the length of one cycle. However, immediately after eleventh crank pulses are consecutively output, a section which corresponds to one interval and in which a crank pulse is not output comes. This section corresponds to a portion having no tooth 59 as shown by the arrow "K" in FIG. 2. The control unit 56 can recognize the position of the crank on the basis of the crank pulse pattern described above. Also, the control unit 56 can recognize the rotational speed of the engine on the basis of the frequency of the crank pulses.

Hereinafter, for convenience of explanation, as shown in FIG. 2, the start positions of the sections obtained by dividing the length of one cycle by 24 are numbered in the order of the sections. Those numbers are from 0 to 23. Further, the start positions of those sections are referred to as crank positions 0, 1, 2, . . . , and 23. The crank positions 0 to 10 (12 to 22) correspond to the teeth 59 (crank pulses), respectively, and the crank position 11 (23) corresponds to the portion having no tooth 59 as shown by the arrow "K" in FIG. 2 (a portion where a crank pulse is not output). Also, FIG. 2 shows the positional relation between the crank sensor 52 and the disk 58 in a case where the piston 34 is positioned at the top dead center. In this case, at a crank position immediately after the crank passes the crank position 6 (18), the piston 34 reaches the top dead center.

(Content of Transient Fuel Injection Process)

The fuel injection device 51 according to the embodiment of the present invention and described above performs a basic fuel injection process and a transient fuel injection process. The basic fuel injection process is a fuel injection process for normal driving, and the transient fuel injection process is a fuel injection process for transient driving. During normal driving, the fuel injection device 51 performs only the basic fuel injection process. In contrast, during transient driving, the fuel injection device 51 performs the basic fuel injection process and the transient fuel injection process. That is, in every cycle, the fuel injection device 51 performs basic fuel injection according to the basic fuel injection process, regardless of existence or non-existence of transient driving. Also, during transient driving, in addition to basic fuel injection according to the basic fuel injection process, transient fuel injection according to the transient fuel injection process is performed. Since the basic fuel injection process of the fuel injection device 51 is a known process, a description thereof will not be made.

Meanwhile, the transient fuel injection process of the fuel injection device 51 is roughly as follows. That is, in the transient fuel injection process which the fuel injection device 51 performs, transient fuel injection quantities are determined on the basis of intake air pressure variation and engine rotational speed. This transient fuel injection quantity determination is performed at predetermined crank positions.

The intake air pressure variation is the variation of the intake air pressure for one cycle. At each predetermined crank position for determining a transient fuel injection quantity, the current intake air pressure is measured by the crank sensor 52. Then, the intake air pressure measured one cycle before at the same crank position by the crank sensor 52 is subtracted from the current crank position, whereby the intake air pressure variation is obtained. For convenience of explanation, hereinafter, the intake air pressure which is measured by the crank sensor 52 will be referred to as the "measured intake air pressure", and a variation in the measured intake air pressure for one cycle will be referred to as a measured intake air pressure variation.

Also, the value of the engine rotational speed which is used to determine the transient fuel injection quantity is the average value of the engine rotational speed for one cycle (corresponding to two revolutions in the present invention). This engine rotational speed value is obtained by measuring the engine rotational speed by the crank sensor 52, multiple times, between the moment for determining the transient fuel injection quantity and a moment earlier than the determination moment by one cycle, and calculating the average of the engine rotational speed.

Also, the transient fuel injection quantity is determined on the basis of the transient fuel injection quantity conversion map, the measured intake air pressure variation (corrected according to a fully-closed-state intake air pressure variation to be described below) and the engine rotational speed measured by the crank sensor 52. The transient fuel injection quantity conversion map is data defining the relation of (corrected) intake air pressure variation, engine rotational speed, and transient fuel injection quantity in advance, and is stored in the storage unit 55 in advance. By referring to the transient fuel injection quantity conversion map, it is possible to determine the transient fuel injection quantity on the basis of the (corrected) intake air pressure variation and the engine rotational speed.

Also, in the transient fuel injection process which the fuel injection device 51 performs, after the measured intake air pressure variation is obtained, the measured intake air pressure variation is corrected according to the fully-closed-state intake air pressure variation, before the transient fuel injection quantity is determined with reference to the transient fuel injection quantity conversion map. The fully-closed-state intake air pressure variation is a variation in the fully-closed-state intake air pressure for one cycle. Also, the fully-closed-state intake air pressure is the intake air pressure when the throttle valve 44 is in the fully closed state. The calculation of the fully-closed-state intake air pressure variation is performed at the predetermined crank position for determining the transient fuel injection quantity. The current fully-closed-state intake air pressure is determined at the predetermined crank position, and the fully-closed-state intake air pressure determined one cycle before at the same crank position is subtracted from the current fully-closed-state intake air pressure, whereby the fully-closed-state intake air pressure variation is obtained.

The fully-closed-state intake air pressure varies depending on the engine rotational speed as will be described below. The fully-closed-state intake air pressure is determined on the basis of a fully-closed-state intake air pressure conversion table and the engine rotational speed measured by the crank sensor 52. The fully-closed-state intake air pressure conversion table is data defining the relation between the engine rotational speed and the fully-closed-state intake air pressure in advance, and is stored in the storage unit 55 in advance. By referring to the fully-closed-state intake air pressure conversion table, it is possible to determine the fully-closed-state intake air pressure on the basis of the engine rotational speed.

Also, the value of the engine rotational speed which is used to determine the fully-closed-state intake air pressure is the average value of the engine rotational speed for one cycle (corresponding to two revolutions in the present embodiment). This value is obtained by measuring the engine rotational speed by the crank sensor 52, multiple times, between the moment for determining the fully-closed-state intake air pressure and a moment earlier than the determination moment by one cycle, and calculating the average of the engine rotational speed.

Figure 3:
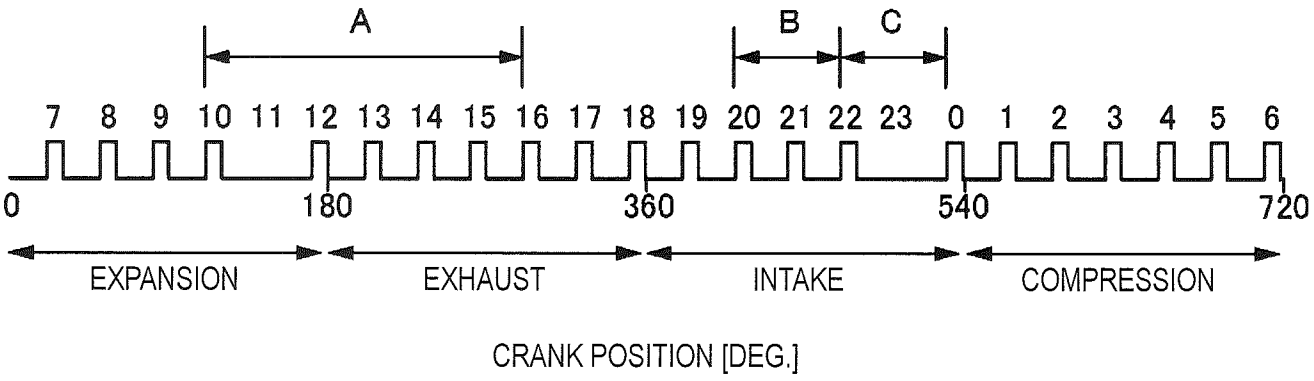
FIG. 3 is an explanatory view illustrating crank positions at which transient fuel injection quantity determination and transient fuel injection are performed in the fuel injection device according to the embodiment of the present invention.

Also, in the transient fuel injection process which the fuel injection device 51 performs, in one cycle, three predetermined crank positions for determining a transient fuel injection quantity are set. Hereinafter, these predetermined crank positions will be referred to as a crank position "A", a crank position "B", and a crank position "C". Here, FIG. 3 shows the setting ranges of the crank positions "A", "B", and "C" in one cycle. A signal waveform of FIG. 3 is the crank pulses which are output from the crank sensor 52. As shown in FIG. 3, the crank position "A" is set in an expansion stroke or an exhaust stroke, specifically, in the latter period of the expansion stroke or the early period of the exhaust stroke, more specifically, in a range from the crank position 10 to the crank position 16. Also, the crank positions "B" and "C" are set to different positions in the intake stroke. The crank position "B" is set specifically in the early period or middle period of the intake stroke, more specifically, in a range from the crank position 20 to the crank position 22, respectively. The crank position "C" is set specifically in the latter period of the intake stroke or in a period immediately before the compression stroke, more specifically, in a range from the crank position 22 to the crank position 0.

The determination of the transient fuel injection quantity is performed at each position of the crank positions "A", "B", and "C". Also, immediately after the transient fuel injection quantity is determined at each position of the crank positions "A", "B", and "C", transient fuel injection of the determined transient fuel injection quantity is instantly performed. Also, transient fuel injection quantity conversion maps are prepared for the crank positions "A", "B", and "C", respectively, and are stored in the storage unit 55. The contents of these three transient fuel injection quantity conversion maps are different from one another. Also, fully-closed-state intake air pressure conversion tables are prepared for the crank positions "A", "B", and "C", respectively, and are stored in the storage unit 55. The contents of these three fully-closed-state intake air pressure conversion tables are different from one another.

Also, in the transient fuel injection process which the fuel injection device 51 performs, after each transient fuel injection quantity is performed on the basis of the transient fuel injection quantity conversion maps, if necessary, an injection quantity adjusting process is performed before transient fuel injection is performed. Here, if a certain crank position which is in one cycle of the engine 30 is referred to as a reference crank position, and the range corresponding to one cycle from the reference crank position is referred to as a reference cycle, and a crank position which is in the reference cycle and where transient fuel injection is performed is referred to as a performance crank position, and crank positions which are in the reference cycle and where transient fuel injection has been already performed before the performance crank position are referred to as performance completion crank positions, the injection quantity adjusting process is a process in which a transient fuel injection quantity obtained by subtracting the sum of transient fuel injection quantities of transient fuel injection performed at the performance completion crank positions from a transient fuel injection quantity determined on the basis of the corrected measured intake air pressure variation, the engine rotational speed, and the transient fuel injection quantity conversion maps is set as a transient fuel injection quantity for transient fuel injection to be performed at the performance crank position.

For example, in a case where the reference crank position is the crank position "A", and transient fuel injection is performed at each of the crank positions "A" and "B", and transient fuel injection will be performed at the crank position "C", each of the crank positions "A" and "B" corresponds to a performance completion crank position, and the crank position "C" corresponds to a performance crank position. In this case, in the injection quantity adjusting process, the sum of transient fuel injection quantities of transient fuel injection performed at the crank positions "A" and "B" are subtracted from a transient fuel injection quantity determined at the crank position "C" on the basis of the corrected measured intake air pressure variation, the engine rotational speed, and the transient fuel injection quantity conversion maps, whereby a transient fuel injection quantity is obtained to be used as a transient fuel injection quantity for transient fuel injection to be performed at the crank position "C".

The injection quantity adjusting process is performed if there is any performance completion crank position in a reference cycle to which a performance crank position belongs in a case of performing transient fuel injection at the performance crank position; otherwise, it is not performed.

(Reasons for Determining Transient Fuel Injection Quantity)

Figure 4:
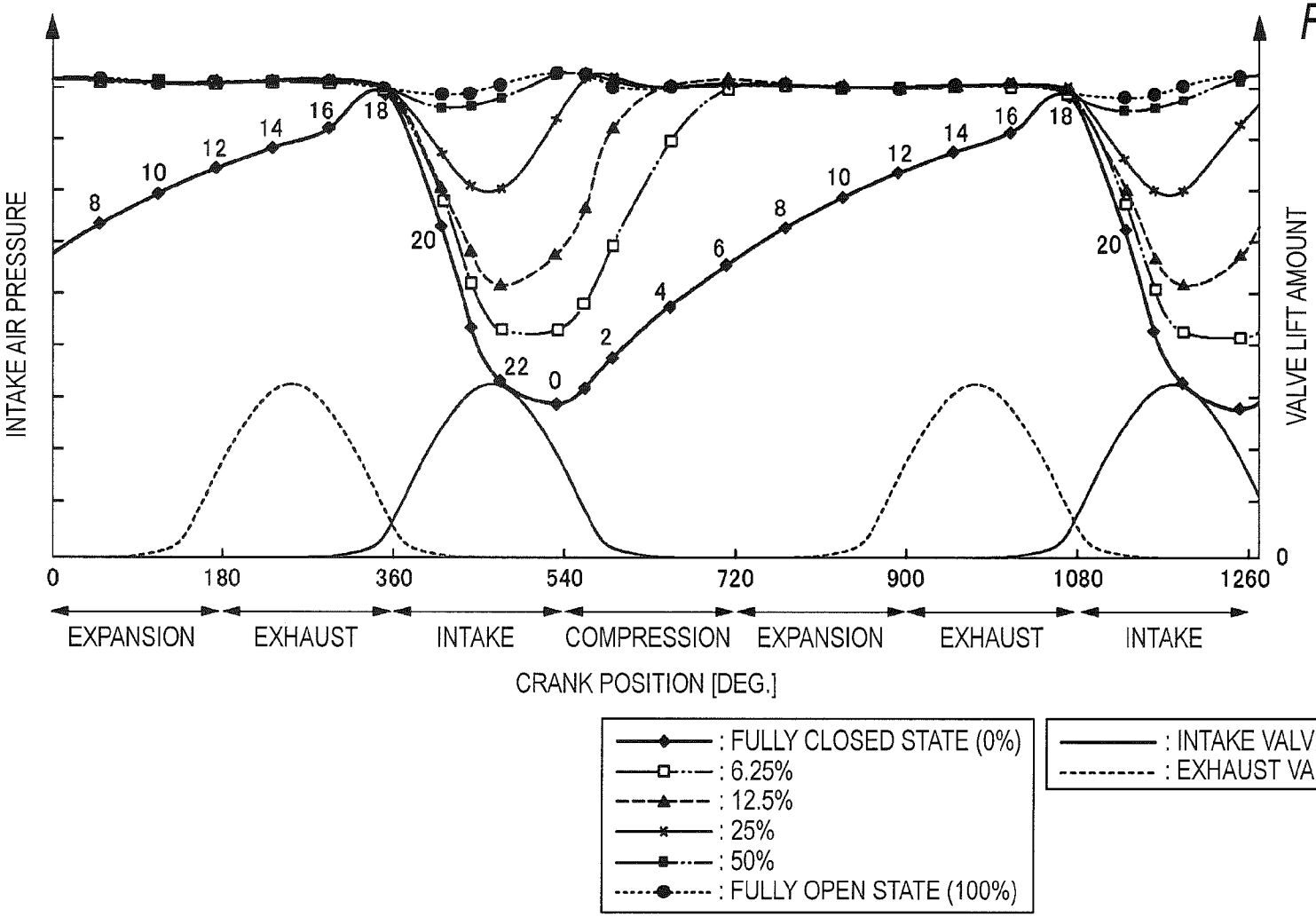
FIG. 4 is a characteristic line diagram illustrating the relation between the position of the crank and intake air pressure with respect to a plurality of different opening degrees of a throttle valve at a predetermined engine rotational speed.

FIG. 4 shows the relation between the position of the crank and the intake air pressure in a case where the rotational speed of the engine 30 is a constant value, with respect to six opening degrees of the throttle valve 44. In FIG. 4, a curve connecting points shown by black lozenges represents the relation between the position of the crank and the intake air pressure in a case where the throttle valve 44 is in the fully closed state. A curve connecting points shown by white squares represents the relation between the position of the crank and the intake air pressure in a case where the opening degree of the throttle valve 44 is 6.25%. A curve connecting points shown by black triangles represents the relation between the position of the crank and the intake air pressure in a case where the opening degree of the throttle valve 44 is 12.5%. A curve connecting points shown by "x" marks represents the relation between the position of the crank and the intake air pressure in a case where the opening degree of the throttle valve 44 is 25%. A curve connecting points shown by black squares represents the relation between the position of the crank and the intake air pressure in a case where the opening degree of the throttle valve 44 is 50%. A curve connecting points shown by black circles represents the relation between the position of the crank and the intake air pressure in a case where the throttle valve 44 is in a fully open state (the opening degree is 100%). Also, FIG. 4 shows the relation between the valve lift amount of each of the intake valve 41 and the exhaust valve 42 and the position of the crank.

Figure 7:
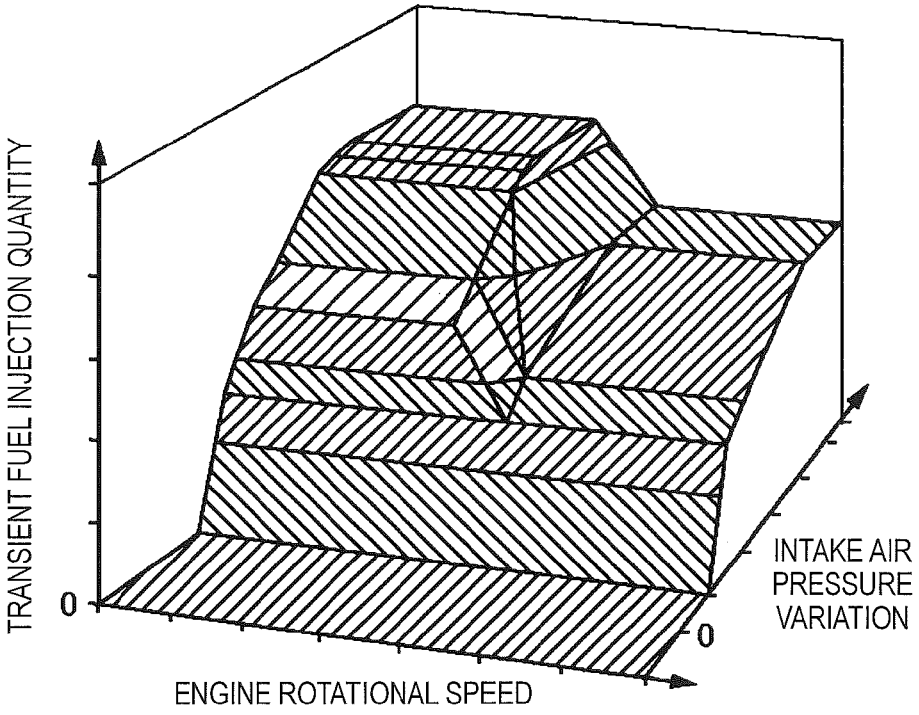
FIG. 7 is an explanatory view illustrating a transient fuel injection quantity conversion map illustrating the relation of intake air pressure variation, engine rotational speed, and transient fuel injection quantity.

As can be seen from FIG. 4, between variation in the opening degree of the throttle valve 44 and variation in the intake air pressure, there is a correlation. Therefore, it is possible to replace a variation in the opening degree of the throttle valve 44 with an intake air pressure variation and determine a transient fuel injection quantity on the basis of the intake air pressure variation. Further, it is possible to generate a transient fuel injection quantity conversion map representing the relation of the intake air pressure variation, the engine rotational speed, and the transient fuel injection quantity by experiments or simulations, and store the transient fuel injection quantity conversion map in the storage unit 55, and obtain a transient fuel injection quantity from an intake air pressure variation and the rotational speed of the engine with reference to the transient fuel injection quantity conversion map. FIG. 7 shows an example of the transient fuel injection quantity conversion map.

Also, as can be seen from FIG. 4, the correlation between the variation in the opening degree of the throttle valve 44 and the variation in the intake air pressure depends on the position of the crank. Therefore, for each of the crank positions "A", "B", and "C" for determining transient fuel injection quantities, experiments or simulations are performed, whereby the relation of the intake air pressure variation, the engine rotational speed, and the transient fuel injection quantity is obtained, and a dedicated transient fuel injection quantity conversion map is generated. Then, the dedicated transient fuel injection quantity conversion maps generated in the above described way for the crank positions "A", "B", and "C" are stored in the storage unit 55. In a case of determining the transient fuel injection quantity at the crank position "A", the transient fuel injection quantity conversion map for the crank position "A" is referred to, and in a case of determining the transient fuel injection quantity at the crank position "B", the transient fuel injection quantity conversion map for the crank position "B" is referred to, and in a case of determining the transient fuel injection quantity at the crank position "C", the transient fuel injection quantity conversion map for the crank position "C" is referred to. As a result, it is possible to obtain accurate transient fuel injection quantities at the crank positions "A", "B", and "C", respectively.

Also, as can be seen from FIG. 4, in the intake stroke, the variation of the intake air pressure relative to the variation in the opening degree of the throttle valve 44 is large. Therefore, at the crank position "B" or "C" belonging to the intake stroke, the transient fuel injection quantity is determined on the basis of the intake air pressure variation. As a result, it is possible to perceive an intake air pressure variation according to an accelerator operation at high resolution, and it is possible to minutely determine a transient fuel injection quantity according to an accelerator operation on the basis of an intake air pressure variation.

Also, as can be seen from FIG. 4, in the expansion stroke and the exhaust stroke, if the opening degree of the throttle valve 44 exceeds a predetermined value (for example, 6.25%), variation of intake air pressure relative to variation in the opening degree of the throttle valve 44 rarely occurs. For this reason, the maximum of a transient fuel injection quantity which is determined on the basis of an intake air pressure variation at the crank position "A" belonging to the expansion stroke or the exhaust stroke is limited to a transient fuel injection quantity which is caused by an accelerator operation of a quantity corresponding to a variation in the opening degree of the throttle valve 44 from the fully closed state to 6.25%.

Figure 5:
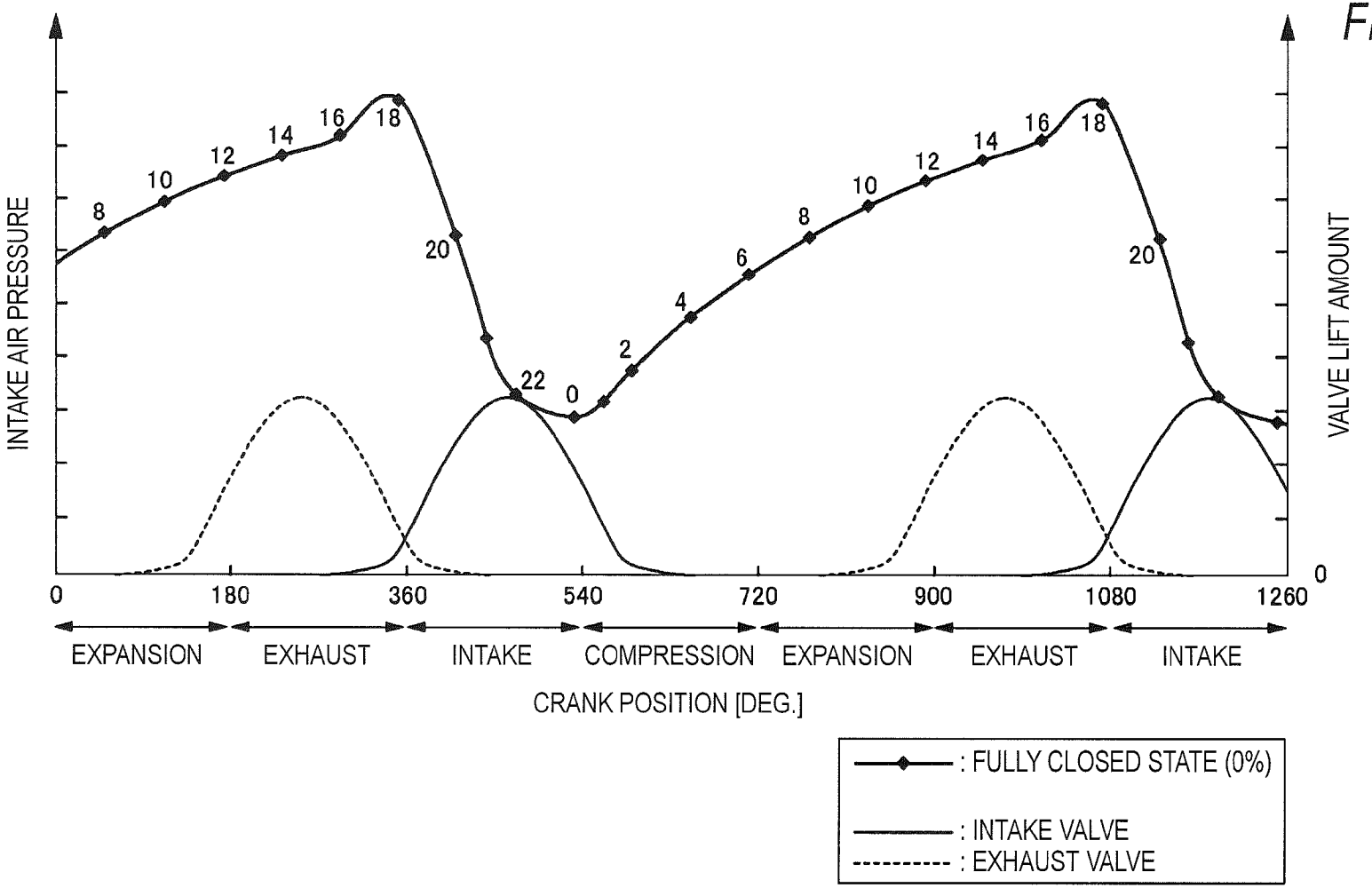
FIG. 5 is a characteristic line diagram illustrating the relation between the position of the crank and intake air pressure in a case where the throttle valve is in a fully closed state at the predetermined engine rotational speed.
Figure 6:
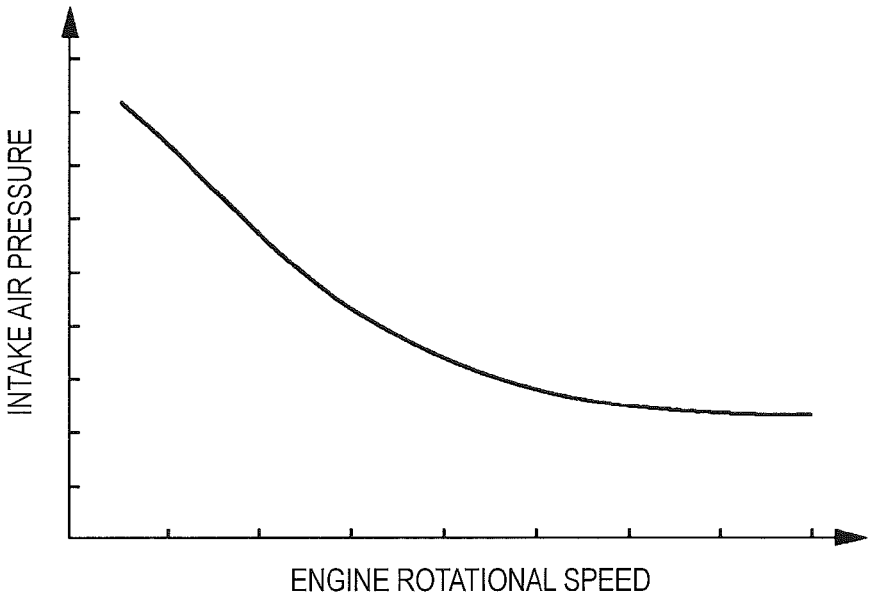
FIG. 6 is a characteristic line diagram illustrating the relation between engine rotational speed and intake air pressure in a case where the throttle valve is in the fully closed state at a predetermined crank position.

Meanwhile, FIG. 5 shows the relation existing between the position of the crank and the intake air pressure in the case where the throttle valve 44 is in the fully closed state and shown in FIG. 4. Further, FIG. 5 shows the relation between the valve lift amount of each of the intake valve 41 and the exhaust valve 42 and the position of the crank. Also, FIG. 6 shows the relation between the engine rotational speed and the intake air pressure in the case where the throttle valve 44 is in the fully closed state.

As can be seen from FIG. 5, even in the case where the throttle valve 44 is in the fully closed state, the intake air pressure varies depending on the position of the crank. Also, as can be seen from FIG. 6, even in the case where the throttle valve 44 is in the fully closed state, at a predetermined crank position, the intake air pressure varies depending on the engine rotational speed. That is, it can be seen from FIG. 6 that even in a state where the opening degree of the throttle valve 44 does not vary, and intake air rarely flows, the intake air pressure varies depending on the engine rotational speed. If an accelerator operation is performed, the opening degree of the throttle valve 44 and the engine rotational speed vary at the same time. For this reason, it can be considered that a variation of the intake air pressure according to an accelerator operation includes a variation of the intake air pressure attributable to a variation in the opening degree of the throttle valve 44 and a variation of the intake air pressure attributable to a variation in the engine rotational speed. Therefore, in the fuel injection device 51, in a case of determining a transient fuel injection quantity, a variation in the intake air pressure for one cycle measured by the crank sensor 52 (that is, a measured intake air pressure variation) is corrected on the basis of a variation in the intake air pressure for one cycle in a case where the throttle valve 44 is in the fully closed state (that is, a fully-closed-state intake air pressure variation). Specifically, the fully-closed-state intake air pressure variation is subtracted from the measured intake air pressure variation. It can be considered that the measured intake air pressure variation includes a portion corresponding to a variation in the opening degree of the throttle valve 44 and a portion corresponding to the variation in the engine rotational speed, and it can be considered that the fully-closed-state intake air pressure variation is a variation corresponding to the variation in the engine rotational speed. Therefore, if the fully-closed-state intake air pressure variation is subtracted from the measured intake air pressure variation, the measured intake air pressure variation gets close to the variation corresponding to the variation in the opening degree of the throttle valve 44. Therefore, at the time of determining a transient fuel injection quantity, a fully-closed-state intake air pressure variation is subtracted from a measured intake air pressure variation, whereby correction is performed. As a result, it is possible to improve the accuracy of a transient fuel injection quantity according to an accelerator operation.

Also, although not shown in the drawings, in the case where the throttle valve 44 is in the fully closed state, a variation of the intake air pressure relative to a variation of the engine rotational speed varies depending on the position of the crank. Therefore, different dedicated fully-closed-state intake air pressure conversion tables are generated for the crank positions "A", "B", and "C", respectively, and are stored in the storage unit 55. Then, in a case of determining a fully-closed-state intake air pressure variation at the crank position "A", the fully-closed-state intake air pressure conversion table for the crank position "A" is referred to, and in a case of determining a fully-closed-state intake air pressure variation at the crank position "B", the fully-closed-state intake air pressure conversion table for the crank position "B" is referred to, and in a case of determining a fully-closed-state intake air pressure variation at the crank position "C", the fully-closed-state intake air pressure conversion table for the crank position "C" is referred to, whereby it is possible to obtain accurate fully-closed-state intake air pressure variations at the crank positions "A", "B", and "C", respectively.

(Specific Example of Fuel Injection Process)

Figure 8:
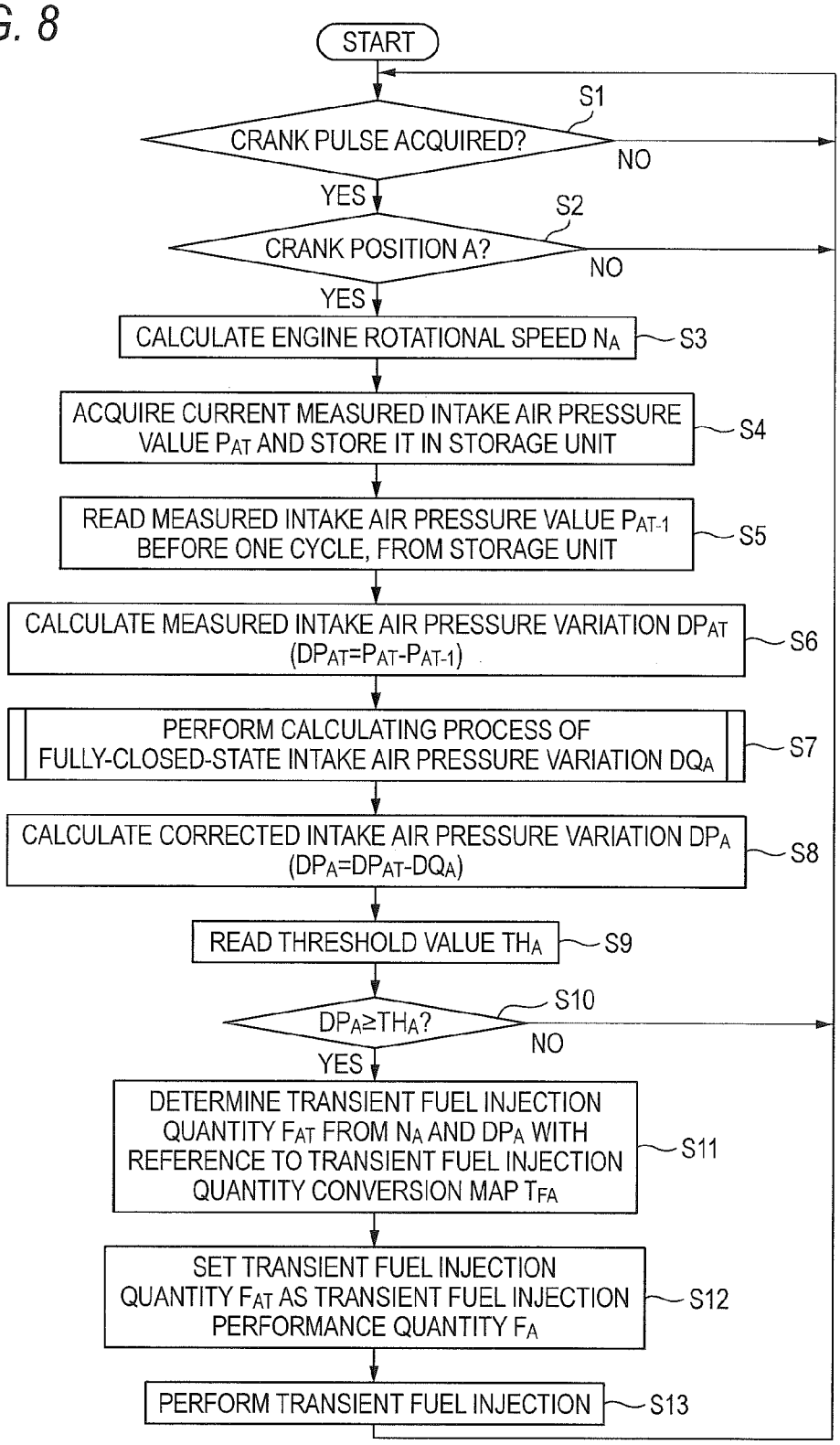
FIG. 8 is a flow chart illustrating a transient fuel injection process at a crank position "A" in the fuel injection device according to the embodiment of the present invention.
Figure 9:
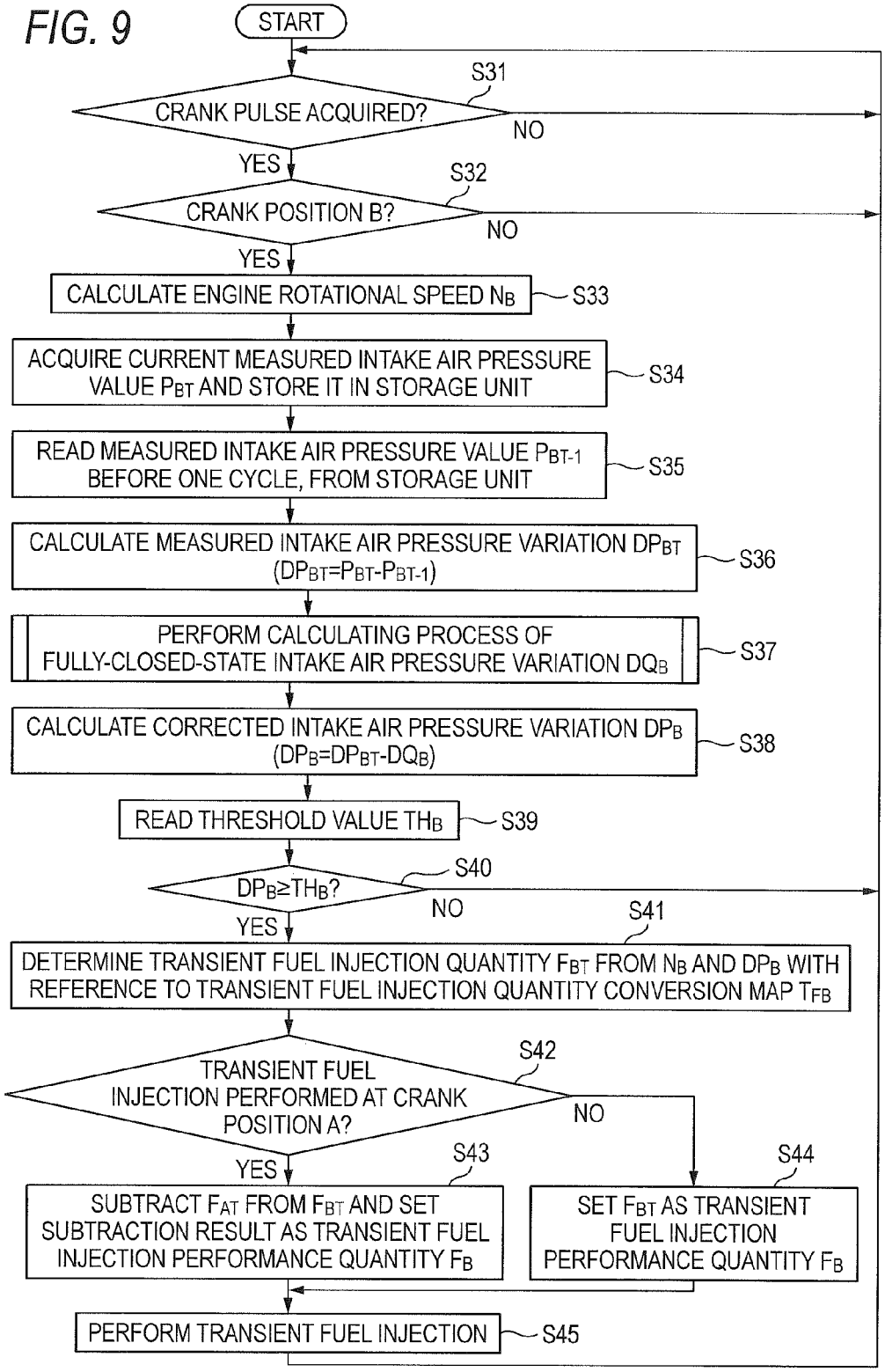
FIG. 9 is a flow chart illustrating a transient fuel injection process at a crank position "B" in the fuel injection device according to the embodiment of the present invention.
Figure 10:
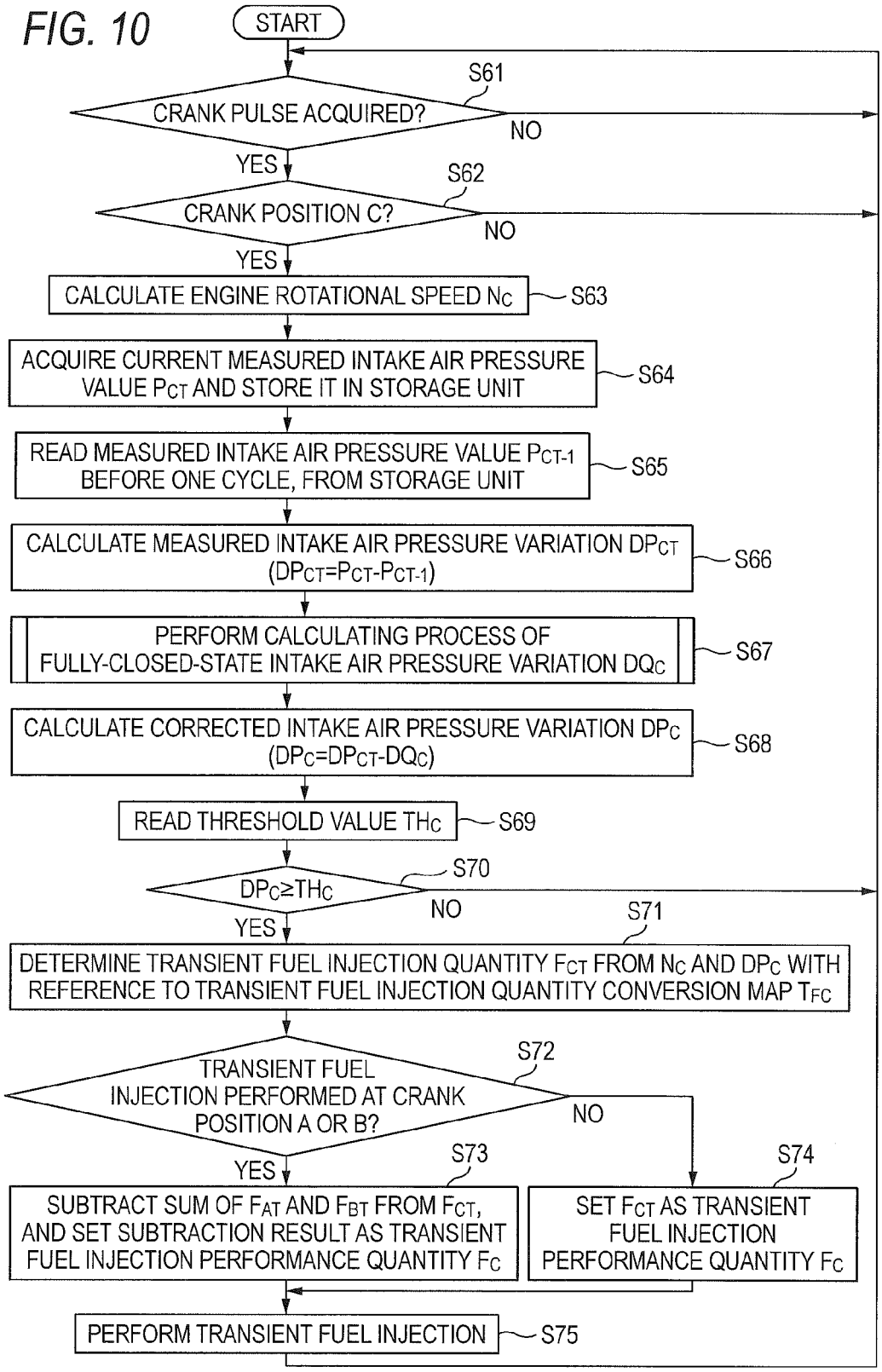
FIG. 10 is a flow chart illustrating a transient fuel injection process at a crank position "C" in the fuel injection device according to the embodiment of the present invention.
Figure 11:
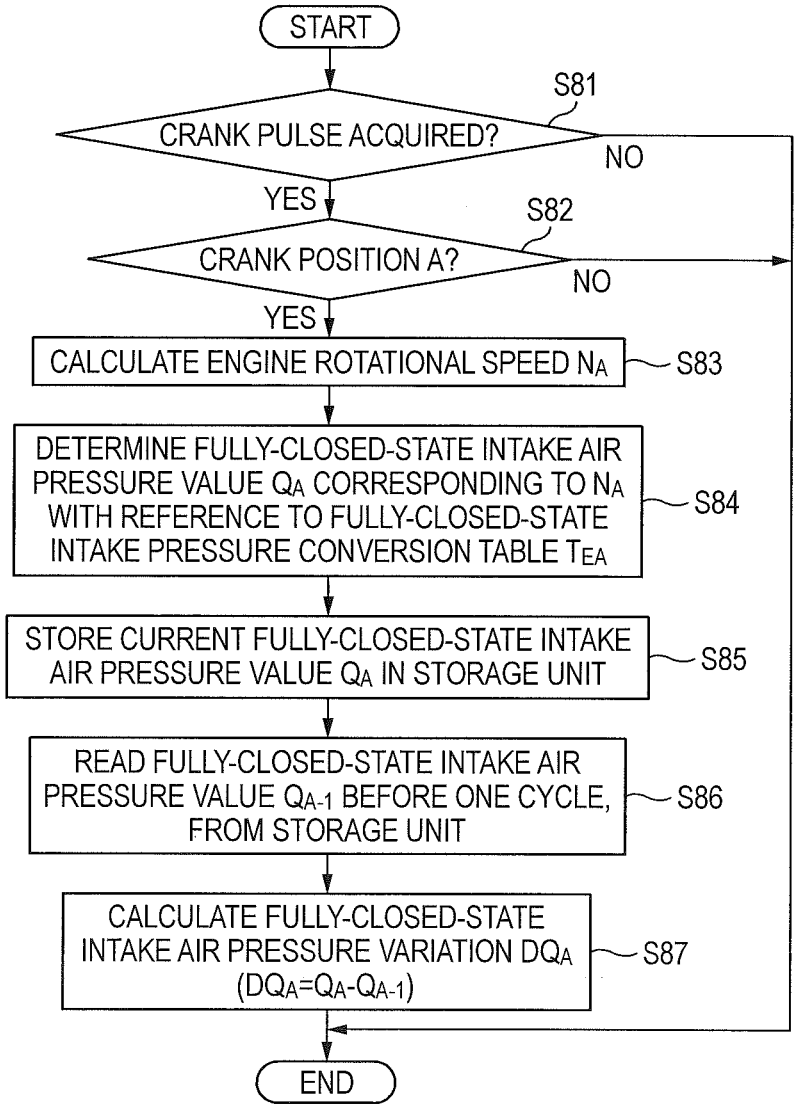
FIG. 11 is a flow chart illustrating a process of calculating a fully-closed-state intake air pressure variation in the fuel injection device according to the embodiment of the present invention.

FIGS. 8 to 11 show specific flows of transient fuel injection processes which the fuel injection device 51 performs. That is, FIG. 8 shows a specific flow of a transient fuel injection process which is performed at the crank position "A", and FIG. 9 shows a specific flow of a transient fuel injection process which is performed at the crank position "B", and FIG. 10 shows a specific flow of a transient fuel injection process which is performed at the crank position "C". FIG. 11 shows a process of calculating a fully-closed-state intake air pressure variation at the crank position "A", as an example of a process which is performed in a transient fuel injection process in order to calculate a fully-closed-state intake air pressure variation.

First, the transient fuel injection process at the crank position "A" is as follows. That is, as shown in FIG. 8, first, in STEP S1, the control unit 56 determines whether any crank pulse output from the crank sensor 52 has been acquired. The control unit 56 waits for any crank pulse to be acquired ("NO" in STEP S1), and if a crank pulse is acquired ("YES" in STEP S1), in STEP S2, the control unit 56 determines whether a crank position corresponding to the acquired crank pulse is the crank position "A".

In a case where the crank position corresponding to the crank pulse acquired in STEP S1 is the crank position "A" ("YES" in STEP S2), in STEP S3, the control unit 56 calculates current engine rotational speed $N_A$ at the crank position "A". The current engine rotational speed $N_A$ is the average of the engine rotational speed from a moment earlier than the current moment by one cycle to the current moment.

Subsequently, in STEP S4, the control unit 56 acquires a current measured intake air pressure value $P_{AT}$ at the crank position "A" from the intake air pressure sensor 53, and stores the acquired measured intake air pressure value $P_{AT}$ in the storage unit 55. Subsequently, in STEP S5, the control unit 56 reads a measured intake air pressure value $P_{AT-1}$ acquired one cycle before at the crank position "A", from the storage unit 55. Subsequently, in STEP S6, the control unit 56 subtracts the measured intake air pressure value $P_{AT-1}$ acquired one cycle before at the crank position "A", from the current measured intake air pressure value $P_{AT}$ acquired at the crank position "A", thereby calculating a measured intake air pressure variation $DP_{AT}$ at the crank position "A".

Subsequently, in STEP S7, the control unit 56 calculates a fully-closed-state intake air pressure variation $DQ_A$ at the crank position "A". The process of calculating the fully-closed-state intake air pressure variation $DQ_A$ is as shown in FIG. 11. That is, in FIG. 11, the control unit 56 acquires a crank pulse ("YES" in STEP S81), and if a crank position corresponding to the acquired crank pulse is the crank position "A" ("YES" in STEP S82), in a STEP S83, the control unit calculates the current engine rotational speed $N_A$ at the crank position "A". The processes of STEPS S81 to S83 are identical to the processes of STEPS S1 to S3 of FIG. 8, and thus can be omitted. Subsequently, in STEP S84, with reference to a fully-closed-state intake air pressure conversion table $T_{EA}$ for the crank position "A", the control unit 56 determines a fully-closed-state intake air pressure value QA corresponding to the current engine rotational speed $N_A$ at the crank position "A". Subsequently, in STEP S85, the control unit 56 stores the fully-closed-state intake air pressure value $Q_A$ as a current fully-closed-state intake air pressure value in the storage unit 55. Subsequently, in STEP S86, the control unit 56 reads a fully-closed-state intake air pressure value $Q_{A-1}$ acquired one cycle before at the crank position "A", from the storage unit 55. Subsequently, in STEP S87, the control unit 56 subtracts the fully-closed-state intake air pressure value $Q_{A-1}$ acquired one cycle before at the crank position "A", from the current fully-closed-state intake air pressure value $Q_A$ acquired at the crank position "A", thereby calculating the fully-closed-state intake air pressure variation $DQ_A$ at the crank position "A". Subsequently, the process proceeds to STEP S8 of FIG. 8.

In STEP S8 of FIG. 8, the control unit 56 corrects the measured intake air pressure variation $DP_{AT}$ acquired at the crank position "A" on the basis of the fully-closed-state intake air pressure variation $DQ_A$ acquired at the crank position "A". Specifically, the control unit subtracts the fully-closed-state intake air pressure variation $DQ_A$ acquired at the crank position "A" from the measured intake air pressure variation $DP_{AT}$ acquired at the crank position "A", thereby calculating a corrected intake air pressure variation $DP_A$ at the crank position "A".

Subsequently, in STEP S9, the control unit 56 reads a threshold value $TH_A$ from the storage unit 55. Here, the threshold value $TH_A$ is a value set for preventing transient fuel injection from being caused, for example, by a small variation of the intake air pressure which does not require transient fuel injection, and is stored in advance in the storage unit 55.

Subsequently, in STEP S10, the control unit 56 determines whether the corrected intake air pressure variation $DP_A$ at the crank position "A" is equal to or greater than the threshold value $TH_A$. In a case where the corrected intake air pressure variation $DP_A$ at the crank position "A" is less than the threshold value $TH_A$ ("NO" in STEP S10), the process returns to STEP S1.

Meanwhile, in a case where the corrected intake air pressure variation $DP_A$ at the crank position "A" is equal to or greater than the threshold value $TH_A$ ("YES" in STEP S10), in STEP S11, with reference to a transient fuel injection quantity conversion map $T_{FA}$ for the crank position "A", the control unit 56 determines a transient fuel injection quantity $F_{AT}$ of the crank position "A" on the basis of the current engine rotational speed $N_A$ acquired at the crank position "A" and the corrected intake air pressure variation $DP_A$ acquired at the crank position "A".

Subsequently, the control unit 56 sets the transient fuel injection quantity $F_{AT}$ of the crank position "A" as a transient fuel injection performance quantity $F_A$ at the crank position "A", in STEP S12, and controls the injector 54 in STEP S13 such that the injector instantly performs transient fuel injection of the transient fuel injection performance quantity $F_A$.

Also, in the transient fuel injection process at the crank position "B" or "C" to be described below, after a transient fuel injection quantity is determined with reference to a transient fuel injection quantity conversion map, the injection quantity adjusting process is performed. However, in the transient fuel injection process at the crank position "A", the injection quantity adjusting process is not performed. That is, in the present specific example, since the reference crank position of the injection quantity adjusting process is set to the crank position "A", in a case where the crank position "A" is a performance crank position, since there is no performance completion crank position in a reference cycle to which the corresponding performance crank position belongs, and thus the injection quantity adjusting process is not performed. In the transient fuel injection process at the crank position, since the injection quantity adjusting process is not performed, in STEP S12, the control unit performs a process of simply setting the transient fuel injection quantity $F_{AT}$ as the transient fuel injection performance quantity $F_A$.

Subsequently, the transient fuel injection process at the crank position "B" is as follows. The transient fuel injection process at the crank position "B" is identical to the transient fuel injection process at the crank position "A", except that a transient fuel injection quantity conversion map $T_{FB}$ for the crank position "B" and a fully-closed-state intake air pressure conversion table $T_{EB}$ for the crank position "B" are used, and at the end of the process, the injection quantity adjusting process (STEPS S42 to S44) is performed.

That is, as shown in FIG. 9, in a case where a crank position corresponding to a crank pulse acquired from the crank sensor 52 is the crank position "B", the control unit 56 calculates current engine rotational speed $N_B$ at the crank position "B" (STEPS S31 to S33). Subsequently, in STEP S34, the control unit 56 acquires a current measured intake air pressure value $P_{BT}$ at the crank position "B" from the intake air pressure sensor 53, and stores the acquired measured intake air pressure value $P_{BT}$ in the storage unit 55. Then, in STEP S35, the control unit reads a measured intake air pressure value $P_{BT-1}$ acquired one cycle before at the crank position "B", from the storage unit 55. Subsequently, in STEP S36, the control unit 56 subtracts the measured intake air pressure value $P_{BT-1}$ acquired one cycle before at the crank position "B", from the current measured intake air pressure value $P_{BT}$ acquired at the crank position "B", thereby calculating a measured intake air pressure variation $DP_{BT}$ at the crank position "B".

Subsequently, in STEP S37, the control unit 56 calculates a fully-closed-state intake air pressure variation $DQ_B$ at the crank position "B". In the process of calculating the fully-closed-state intake air pressure variation $DQ_B$, the control unit 56 determines a fully-closed-state intake air pressure value $Q_B$ corresponding to the current engine rotational speed $N_B$ at the crank position "B", with reference to a fully-closed-state intake air pressure conversion table $T_{EB}$ for the crank position "B", and stores the fully-closed-state intake air pressure value $Q_B$ as a current fully-closed-state intake air pressure value of the crank position "B" in the storage unit 55. Thereafter, the control unit 56 reads a fully-closed-state intake air pressure value $Q_{B-1}$ acquired one cycle before at the crank position "B", from the storage unit 55, and subtracts the fully-closed-state intake air pressure value $Q_{B-1}$ acquired one cycle before at the crank position "B", from the current fully-closed-state intake air pressure value $Q_B$ acquired at the crank position "B", thereby calculating the fully-closed-state intake air pressure variation $DQ_B$ at the crank position "B" (see FIG. 11).

Subsequently, in STEPS S38 and S39, the control unit subtracts the fully-closed-state intake air pressure variation $DQ_B$ acquired at the crank position "B" from the measured intake air pressure variation $DP_{BT}$ acquired at the crank position "B", thereby calculating a corrected intake air pressure variation $DP_B$ at the crank position "B". Then, if the corrected intake air pressure variation $DP_B$ at the crank position "B" is equal to or greater than the threshold value $TH_B$ (STEP S40), in STEP S41, with reference to a transient fuel injection quantity conversion map $T_{FB}$ for the crank position "B", the control unit 56 determines a transient fuel injection quantity $F_{BI}$ of the crank position "B" on the basis of the corrected intake air pressure variation $DP_B$ acquired at the crank position "B" and the current engine rotational speed $N_B$ acquired at the crank position "B".

Subsequently, the control unit 56 performs the injection quantity adjusting process. In the present specific example, since the reference crank position of the injection quantity adjusting process is set to the crank position "A", the reference cycle is a range corresponding to one cycle from the crank position "A". In the injection quantity adjusting process at the crank position "B", the crank position "B" is a performance crank position, and in a case where transient fuel injection has been performed at the crank position "A", the crank position "A" is a performance completion crank position.

Hereinafter, the injection quantity adjusting process at the crank position "B" will be described in detail. First, in STEP S42, the control unit 56 determines whether transient fuel injection has been performed at the crank position "A". In a case where transient fuel injection has been performed at the crank position "A" ("YES" in STEP S42), in STEP S43, the control unit 56 subtracts the transient fuel injection performance quantity $F_A$ from the transient fuel injection quantity $F_{BT}$ of the crank position "B", thereby obtaining a value, and sets the obtained value as a transient fuel injection performance quantity $F_B$ at the crank position "B". Meanwhile, in a case where transient fuel injection has not been performed at the crank position "A" ("NO" in STEP S42), in STEP S44, the control unit 56 sets the transient fuel injection quantity $F_{BT}$ of the crank position "B" as the transient fuel injection performance quantity $F_B$ of the crank position "B".

Subsequently, in STEP S45, the control unit 56 controls the injector 54 such that the injector instantly performs transient fuel injection of the transient fuel injection performance quantity $F_B$.

Subsequently, the transient fuel injection process at the crank position "C" is as follows. The transient fuel injection process at the crank position "C" is identical to the transient fuel injection process at the crank position "B", except that a transient fuel injection quantity conversion map $T_{FC}$ for the crank position "C" and a fully-closed-state intake air pressure conversion table $T_{EC}$ for the crank position "C" are used.

That is, as shown in FIG. 10, in a case where a crank position corresponding to a crank pulse acquired from the crank sensor 52 is the crank position "C", the control unit 56 calculates current engine rotational speed $N_C$ at the crank position "C" (STEPS S61 to S63). Subsequently, in STEP S64, the control unit 56 acquires a current measured intake air pressure value $P_{CT}$ at the crank position "C" from the intake air pressure sensor 53, and stores the acquired measured intake air pressure value $P_{CT}$ in the storage unit 55. Then, in STEP S65, the control unit reads a measured intake air pressure value $P_{CT-1}$ acquired one cycle before at the crank position "C", from the storage unit 55. Subsequently, in STEP S66, the control unit 56 subtracts the measured intake air pressure value $P_{CT-1}$ acquired one cycle before at the crank position "C", from the current measured intake air pressure value $P_{CT}$ acquired at the crank position "C", thereby calculating a measured intake air pressure variation $DP_{CT}$ at the crank position "C".

Subsequently, in STEP S67, the control unit 56 calculates a fully-closed-state intake air pressure variation $DQ_C$ at the crank position "C". In the process of calculating the fully-closed-state intake air pressure variation $DQ_C$, the control unit 56 determines a fully-closed-state intake air pressure value $Q_C$ corresponding to the current engine rotational speed $N_C$ at the crank position "C", with reference to a fully-closed-state intake air pressure conversion table $T_{EC}$ for the crank position "C", and stores the fully-closed-state intake air pressure value $Q_C$ as a current fully-closed-state intake air pressure value of the crank position "C". Thereafter, the control unit 56 reads a fully-closed-state intake air pressure value $Q_{C-1}$ acquired one cycle before at the crank position "C", from the storage unit 55, and subtracts the fully-closed-state intake air pressure value $Q_{C-1}$ acquired one cycle before at the crank position "C", from the current fully-closed-state intake air pressure value $Q_C$ acquired at the crank position "C", thereby calculating the fully-closed-state intake air pressure variation $DQ_C$ at the crank position "C" (see FIG. 11).

Subsequently, in STEPS S68 and S69, the control unit 56 subtracts the fully-closed-state intake air pressure variation $DQ_C$ acquired at the crank position "C" from the measured intake air pressure variation $DP_{CT}$ acquired at the crank position "C", thereby calculating a corrected intake air pressure variation $DP_C$ at the crank position "C". Then, if the corrected intake air pressure variation $DP_C$ at the crank position "C" is equal to or greater than a threshold value $TH_C$ (STEP S70), in STEP S71, with reference to the transient fuel injection quantity conversion map $T_{FC}$ for the crank position "C", the control unit 56 determines a transient fuel injection quantity $F_{CT}$ of the crank position "C" on the basis of the corrected intake air pressure variation $DP_C$ acquired at the crank position "C" and the current engine rotational speed $N_C$ acquired at the crank position "C".

Subsequently, the control unit 56 performs the injection quantity adjusting process. Similarly to the reference crank position of the injection quantity adjusting process at the crank position "B", the reference crank position of the injection quantity adjusting process at the crank position "C" is set to the crank position "A". In the injection quantity adjusting process at the crank position "C", first, in STEP S72, the control unit 56 determines whether transient fuel injection has been performed at the crank position "A" or "B". In a case where transient fuel injection has been performed at both of the crank positions "A" and "B" ("YES" in STEP S72), in STEP S73, the control unit 56 subtracts the sum of the transient fuel injection performance quantity $F_A$ of the crank position "A" and the transient fuel injection performance quantity $F_B$ of the crank position "B" from the transient fuel injection quantity $F_{CT}$ of the crank position "C", thereby obtaining a value, and sets the obtained value as a transient fuel injection performance quantity $F_C$ at the crank position "C". Also, in a case where transient fuel injection has been performed only at the crank position "A", the control unit 56 subtracts the transient fuel injection performance quantity $F_A$ of the crank position "A" from the transient fuel injection quantity $F_{CT}$ of the crank position "C", thereby obtaining a value, and sets the obtained value as the transient fuel injection performance quantity $F_C$ at the crank position "C". Also, in a case where transient fuel injection has been performed only at the crank position "B", the control unit 56 subtracts the transient fuel injection performance quantity $F_B$ of the crank position "B" from the transient fuel injection quantity $F_{CT}$ of the crank position "C", thereby obtaining a value, and sets the obtained value as the transient fuel injection performance quantity $F_C$ at the crank position "C". Meanwhile, in a case where transient fuel injection has not been performed at any of the crank positions "A" and "B" ("NO" in STEP S72), in STEP S74, the control unit 56 sets the transient fuel injection quantity $F_T$ of the crank position "C" as the transient fuel injection performance quantity $F_C$ at the crank position "C".

Subsequently, in STEP S75, the control unit 56 controls the injector 54 such that the injector instantly performs transient fuel injection of the transient fuel injection performance quantity $F_C$.

As described above, according to the fuel injection device 51 based on the embodiment of the present invention, since a transient fuel injection quantity is determined on the basis of a measured intake air pressure variation corrected on the basis of a fully-closed-state intake air pressure variation, it is possible to implement determination of an accurate transient fuel injection quantity according to a driving operation during transient driving. Also, since a plurality of crank positions for performing transient fuel injection is set in one cycle, and transient fuel injection quantities are determined at those crank positions on the basis of different dedicated transient fuel injection quantity conversion maps and different dedicated fully-closed-state intake air pressure conversion tables, respectively, it is possible to implement determination of an accurate transient fuel injection quantity and quick performance of transient fuel injection according to a driving operation. Further, at each of the plurality of crank positions set in one cycle, immediately after determination of a transient fuel injection quantity, transient fuel injection is performed. Therefore, it is possible to implement quick performance of transient fuel injection according to a driving operation during transient driving. Furthermore, since it is possible to perform determination of an accurate transient fuel injection quantity and quick performance of transient fuel injection on the basis of an intake air pressure variation and the rotational speed of the engine, at the time of performing a transient fuel injection process, the detection value of the opening degree of the throttle valve 44 is unnecessary. Therefore, in a case where the opening degree of the throttle valve 44 is unnecessary at the time of performing the basic fuel injection process (a case where the speed density system is used in the basic fuel injection process), it is possible to remove the throttle sensor for detecting the opening degree of the throttle valve 44, from the engine 30, and thus it is possible to reduce the size and cost of the engine.

Also, according to the fuel injection device 51 based on the embodiment of the present invention, since the crank position "B" for performing determination of a transient fuel injection quantity and transient fuel injection is set in the intake stroke in which variation of the intake air pressure relative to variation in the opening degree of the throttle valve 44 is large as shown in FIGS. 3 and 4, it is possible to minutely determine a transient fuel injection quantity according to an accelerator operation on the basis of an intake air pressure variation. Also, since the crank position "A" for performing determination of a transient fuel injection quantity and transient fuel injection is set in the expansion stroke or the exhaust stroke, for example, at the time of operating the engine in a case where the engine is cold, at the time of driving in a low-temperature environment, or when the opening degree of the throttle valve has suddenly and significantly increased due to a sudden and significant accelerator operation, even if a required transient fuel injection quantity suddenly and significantly increases, it is possible to surely and quickly perform injection of the whole of the transient fuel injection quantity, and it is possible to improve the accuracy and rapidity of transient fuel injection. Also, in the intake stroke, in addition to the crank position "B", the crank position "C" is set as a crank position for performing determination of a transient fuel injection quantity and transient fuel injection, such that it is possible to perform transient fuel injection twice in the intake stroke. Therefore, it is possible to implement accurate transient fuel injection according to a quick accelerator operation for a short time like a snap operation.

Also, since the injection quantity adjusting process is performed in the fuel injection device 51 according to the embodiment of the present invention, it is possible to remove a common quantity to the plurality of transient fuel injection quantities determined at the crank positions "A", "B", and "C" in one cycle, and it is possible to prevent each transient fuel injection quantity from excessively increasing.

Also, in the above described embodiment, a case of setting the three crank positions "A", "B", and "C" as crank positions for performing determination of a transient fuel injection quantity and transient fuel injection in one cycle has been described as an example. However, the present invention is not limited thereto. For example, in one cycle, two crank positions for performing determination of a transient fuel injection quantity and transient fuel injection may be set. In this case, one of the two crank positions for performing determination of a transient fuel injection quantity and transient fuel injection is set in the intake stroke, and the other one is set in the expansion stroke or the exhaust stroke. Alternatively, both of the two crank positions for performing determination of a transient fuel injection quantity and transient fuel injection may be set in the intake stroke without setting any crank position for performing determination of a transient fuel injection quantity and transient fuel injection in any of the expansion stroke and the exhaust stroke. Also, in one cycle, four or more crank positions for performing determination of a transient fuel injection quantity and transient fuel injection may be set.

Also, in the above described embodiment, a case of correcting a measured intake air pressure variation on the basis of a fully-closed-state intake air pressure variation has been described. However, in other modes of the present invention, a configuration in which a measured intake air pressure variation is not corrected on the basis of a fully-closed-state intake air pressure variation may be used. In this case, it is impossible to achieve the effect of correcting a measured intake air pressure variation on the basis of a fully-closed-state intake air pressure variation. However, if determination of a transient fuel injection quantity and transient fuel injection are performed on the basis of an intake air pressure variation and the rotational speed of the engine at each of the plurality of crank positions, it is possible to quickly perform transient fuel injection without using the throttle sensor.

Also, in the above described embodiment, a case of applying the fuel injection device of the present invention to a single-cylinder engine has been described as an example. However, the fuel injection device of the present invention can also be applied to a multi-cylinder engine.

Also, the present invention may be modified without departing from the gist or idea of the present invention which can be read from the claims and the whole of the specification, and fuel injection devices according to those modifications are also included in the technical idea of the present invention.

What is claimed is:

1. A fuel injection device for performing fuel injection in an engine, comprising:

a crank position detecting unit configured to detect a position of a crank of the engine;

a speed measuring unit configured to measure a rotational speed of the engine;

an intake air pressure measuring unit configured to measure an intake air pressure of the engine;

a fuel injecting unit configured to inject fuel in the engine;

a storage unit; and a control unit configured to determine a transient fuel injection quantity which is a quantity of transient fuel injection which is fuel injection during transient driving, and to control the transient fuel injection of the fuel injecting unit, wherein if a variation in the intake air pressure for one cycle of the engine is referred to as an intake air pressure variation, and the intake air pressure of the engine when a throttle valve for opening and closing an intake passage of the engine is in a fully closed state is referred to as fully-closed-state intake air pressure, and a variation in the fully-closed-state intake air pressure for one cycle of the engine is referred to as a fully-closed-state intake air pressure variation, in the storage unit, a transient fuel injection quantity conversion data item defining a relation of the intake air pressure variation of the engine, the rotational speed of the engine, and the transient fuel injection quantity of the engine at a predetermined crank position in advance, and a fully-closed-state intake air pressure conversion data item defining a relation between the rotational speed of the engine and the fully-closed-state intake air pressure of the engine in the predetermined crank position in advance are stored, wherein the control unit recognizes the predetermined crank position on the basis of detection of the crank position detecting unit, wherein the control unit recognizes a current rotational speed of the engine measured at the predetermined crank position by the speed measuring unit, and a previous rotational speed of the engine measured one cycle before by the speed measuring unit, wherein the control unit recognizes a current intake air pressure of the engine measured at the predetermined crank position by the intake air pressure measuring unit, and a previous intake air pressure of the engine measured one cycle before by the intake air pressure measuring unit, wherein on the basis of the current intake air pressure and the previous intake air pressure of the engine at the predetermined crank position, the control unit calculates the intake air pressure variation of the engine at the predetermined crank position, as a measured intake air pressure variation, wherein on the basis of the current rotational speed and the previous rotational speed of the engine at the predetermined crank position, and the fully-closed-state intake air pressure conversion data item, the control unit calculates the fully-closed-state intake air pressure variation of the engine at the predetermined crank position, wherein the control unit corrects the measured intake air pressure variation on the basis of the fully-closed-state intake air pressure variation, and wherein on the basis of the corrected measured intake air pressure variation, the current rotational speed of the engine at the predetermined crank position, and the transient fuel injection quantity conversion data item, the control unit determines the transient fuel injection quantity of the engine at the predetermined crank position.

2. The fuel injection device according to claim 1, wherein the predetermined crank position is set as a plurality of predetermined crank positions in the one cycle, and in the storage unit, a plurality of different transient fuel injection quantity conversion data items determined for the plurality of predetermined crank positions, and a plurality of different fully-closed-state intake air pressure conversion data items determined for the plurality of predetermined crank positions are stored.

3. The fuel injection device according to claim 2, wherein one of the plurality of predetermined crank positions is set in an intake stroke of the engine, and another one is set in an expansion stroke or exhaust stroke of the engine.

4. The fuel injection device according to claim 2, wherein two of the plurality of predetermined crank positions are set at different positions in an intake stroke of the engine, respectively.

5. The fuel injection device according to claim 1, wherein the control unit controls the fuel injecting unit to perform the transient fuel injection at each of the plurality of predetermined crank positions.

6. The fuel injection device according to claim 5, wherein if a certain crank position in the one cycle of the engine is referred to as a reference crank position, and a range corresponding to one cycle from the reference crank position is referred to as a reference cycle, and a crank position at which the transient fuel injection is performed in the reference cycle is referred to as a performance crank position, and crank positions at which the transient fuel injection has been already performed in the reference cycle are referred to as performance completion crank positions, the control unit subtracts a sum of transient fuel injection quantities of the transient fuel injection performed at the performance completion crank positions from the transient fuel injection quantity determined on the basis of the corrected measured intake air pressure variation, the rotational speed of the engine, and the transient fuel injection quantity conversion data items at the performance crank position, thereby obtaining a transient fuel injection quantity, and sets the obtained transient fuel injection quantity as the transient fuel injection quantity for transient fuel injection to be performed at the performance crank position.

7. A fuel injection device for performing fuel injection in an engine, comprising:

a crank position detecting unit configured to perform a position of a crank of the engine;

a speed measuring unit configured to measure a rotational speed of the engine;

an intake air pressure measuring unit configured to measure an intake air pressure of the engine;

a fuel injecting unit configured to inject fuel in the engine;

a storage unit; and a control unit configured to determine a transient fuel injection quantity which is a quantity of transient fuel injection which is fuel injection during transient driving, and to control the transient fuel injection of the fuel injecting unit, wherein if a variation in the intake air pressure for one cycle of the engine is referred to as an intake air pressure variation, in the storage unit, a transient fuel injection quantity conversion data item defining a relation of the intake air pressure variation of the engine, the rotational speed of the engine, and the transient fuel injection quantity of the engine at a predetermined crank position in advance is stored, wherein the control unit recognizes the predetermined crank position on the basis of detection of the crank position detecting unit, wherein the control unit recognizes a current rotational speed of the engine measured at the predetermined crank position by the speed measuring unit, wherein the control unit recognizes a current intake air pressure of the engine measured at the predetermined crank position by the intake air pressure measuring unit, and a previous intake air pressure of the engine measured one cycle before by the intake air pressure measuring unit, wherein on the basis of the current intake air pressure and the previous intake air pressure of the engine at the predetermined crank position, the control unit calculates the intake air pressure variation of the engine at the predetermined crank position, as a measured intake air pressure variation, wherein on the basis of the measured intake air pressure variation, the current rotational speed of the engine at the predetermined crank position, and the transient fuel injection quantity conversion data item, the control unit determines the transient fuel injection quantity of the engine at the predetermined crank position, wherein the control unit controls the fuel injecting unit to perform the transient fuel injection of the determined transient fuel injection quantity at the predetermined crank position, and wherein the predetermined crank position is set as a plurality of predetermined crank positions in the one cycle, and at each of the plurality of crank positions, the control unit performs determination of the transient fuel injection quantity and the transient fuel injection of the determined transient fuel injection quantity.

8. The fuel injection device according to claim 7, wherein one of the plurality of predetermined crank positions is set in an intake stroke of the engine, and another one is set in an expansion stroke or exhaust stroke of the engine.

9. The fuel injection device according to claim 7, wherein two of the plurality of predetermined crank positions are set at different positions in an intake stroke of the engine, respectively.

10. The fuel injection device according to claim 7, wherein if a certain crank position in the one cycle of the engine is referred to as a reference crank position, and a range corresponding to one cycle from the reference crank position is referred to as a reference cycle, and a crank position at which the transient fuel injection is performed in the reference cycle is referred to as a performance crank position, and crank positions at which the transient fuel injection has been already performed in the reference cycle is referred to as performance completion crank positions, the control unit subtracts a sum of transient fuel injection quantities of the transient fuel injection performed at the performance completion crank positions from the transient fuel injection quantity determined on the basis of the measured intake air pressure variation, the rotational speed of the engine, and the transient fuel injection quantity conversion data items at the performance crank position, thereby obtaining a transient fuel injection quantity, and sets the obtained transient fuel injection quantity as the transient fuel injection quantity for transient fuel injection to be performed at the performance crank position.

* * * * *